US012663161B2

(12) United States Patent
Deshpande et al.

(10) Patent No.: US 12,663,161 B2
(45) Date of Patent: Jun. 23, 2026

(54) INTEGRATED COOLING SYSTEM FOR AN APPLIANCE

(71) Applicant: WHIRLPOOL CORPORATION, Benton Harbor, MI (US)

(72) Inventors: Alok Chandrakant Deshpande, Lombardia (IT); Nicholas Joseph Kormanik, III, St. Joseph, MI (US); Eduardo Sant Anna Martins, Joinville (BR); Eric Michael Monville, St. Joseph, MI (US); Joseph Edward Rendzikowski, St. Joseph, MI (US); Alberto Regio Gomes, Milton, GA (US); Pavan M. Meti, Maharashtra (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 433 days.

(21) Appl. No.: 18/494,133

(22) Filed: Oct. 25, 2023

(65) Prior Publication Data

US 2025/0137655 A1 May 1, 2025

(51) Int. Cl.
*F24C 15/00* (2006.01)

(52) U.S. Cl.
CPC ..... *F24C 15/006* (2013.01)

(58) Field of Classification Search
CPC ..... F24C 15/322; F24C 15/006
See application file for complete search history.

(56) References Cited

U.S. PATENT DOCUMENTS

| | | | |
|---|---|---|---|
| 3,310,046 | A | 3/1967 | Scott et al. |
| 3,889,099 | A | 6/1975 | Nuss |
| 3,889,100 | A | 6/1975 | Dills |
| 4,241,718 | A | 12/1980 | Barnett |
| 5,388,956 | A | 2/1995 | Pla et al. |
| 6,172,338 | B1 | 1/2001 | Barnes et al. |
| 10,119,706 | B2 | 11/2018 | Chadwick et al. |
| 10,288,295 | B2 | 5/2019 | Chadwick et al. |
| 10,393,142 | B2 | 8/2019 | Frater et al. |
| 10,488,054 | B2 | 11/2019 | Johnson |
| 11,313,564 | B2 | 4/2022 | Chadwick et al. |
| 2015/0075513 | A1 | 3/2015 | Paller et al. |
| 2022/0082266 | A1 | 3/2022 | Perugu et al. |

FOREIGN PATENT DOCUMENTS

| | | | |
|---|---|---|---|
| FR | 2726633 | A1 | 11/1996 |
| WO | 2010149524 | A2 | 12/2010 |

*Primary Examiner* — Ko-Wei Lin
(74) *Attorney, Agent, or Firm* — Price Heneveld LLP

(57) ABSTRACT

A cooking appliance includes a cooking cavity having first and second sidewalls that are spaced-apart from one another. A housing includes first and second sidewalls that are spaced-apart from one another and an upper wall. The first and second sidewalls of the housing are spaced-apart from the first and second sidewalls of the cooking cavity to define first and second side channels therebetween, respectively. A duct assembly includes first and second sidewalls spaced-apart from one another and an upper wall. The duct assembly is positioned on the upper wall of the housing and includes an interior cavity having a front opening and a rear opening. A blower assembly includes an inlet operably coupled to the rear opening of the duct assembly and is fluidically coupled to the first and second channels. The blower assembly includes an upwardly opening rear outlet having a plurality of baffles and deflectors positioned therein.

20 Claims, 17 Drawing Sheets

INTEGRATED COOLING SYSTEM FOR AN APPLIANCE

BACKGROUND OF THE DISCLOSURE

The present disclosure generally relates to an integrated cooling system for an appliance, and more specifically, to an integrated cooling system that effectively cools a range appliance while reducing noise.

SUMMARY OF THE DISCLOSURE

According to one aspect of the present disclosure, a cooking appliance includes a cooking cavity having first and second sidewalls that are spaced-apart from one another. A housing includes first and second sidewalls that are spaced-apart from one another and an upper wall. The first and second sidewalls of the housing are spaced-apart from the first and second sidewalls of the cooking cavity to define first and second side channels therebetween, respectively. A duct assembly includes first and second sidewalls spaced-apart from one another and an upper wall. The duct assembly is positioned on the upper wall of the housing and includes an interior cavity having a front opening and a rear opening. A blower assembly includes an inlet operably coupled to the rear opening of the duct assembly and is fluidically coupled to the first and second channels. The blower assembly includes an upwardly opening rear outlet.

According to another aspect of the present disclosure, a cooking appliance includes a housing surrounding a cooking cavity. The housing includes an upper portion having a control housing with a plurality of air inlets opening into an interior portion of the control housing. A door selectively provides access to the cooking cavity and includes upper and lower plates disposed on opposite ends of an interior portion of the door. The upper plate includes a plurality of air inlets opening into the interior portion of the door. A blower assembly includes an inlet fluidically coupled to the interior portion of the control housing and the interior portion of the door. The blower assembly further includes an outlet disposed on an upper rear portion of the housing.

According to yet another aspect of the present disclosure, a cooking appliance includes a housing having a cooking cavity received therein. A blower assembly includes a motor housing having one or more blowers. An outlet assembly includes an interior channel culminating in an upwardly opening rear air outlet. The interior channel includes one or more deflectors disposed in a first portion of the interior channel. The one or more deflectors are configured to guide air from the first portion of the interior channel to a second portion of the interior channel. A first vertical airflow path is guided by the one or more deflectors to a horizontal airflow path from the first portion of the interior channel to the second portion of the interior channel. The rear air outlet includes a plurality of baffles disposed in a third portion of the interior channel. The horizontal airflow path is guided by the plurality of baffles to a second vertical airflow path.

These and other features, advantages, and objects of the present disclosure will be further understood and appreciated by those skilled in the art by reference to the following specification, claims, and appended drawings.

Figure 1:
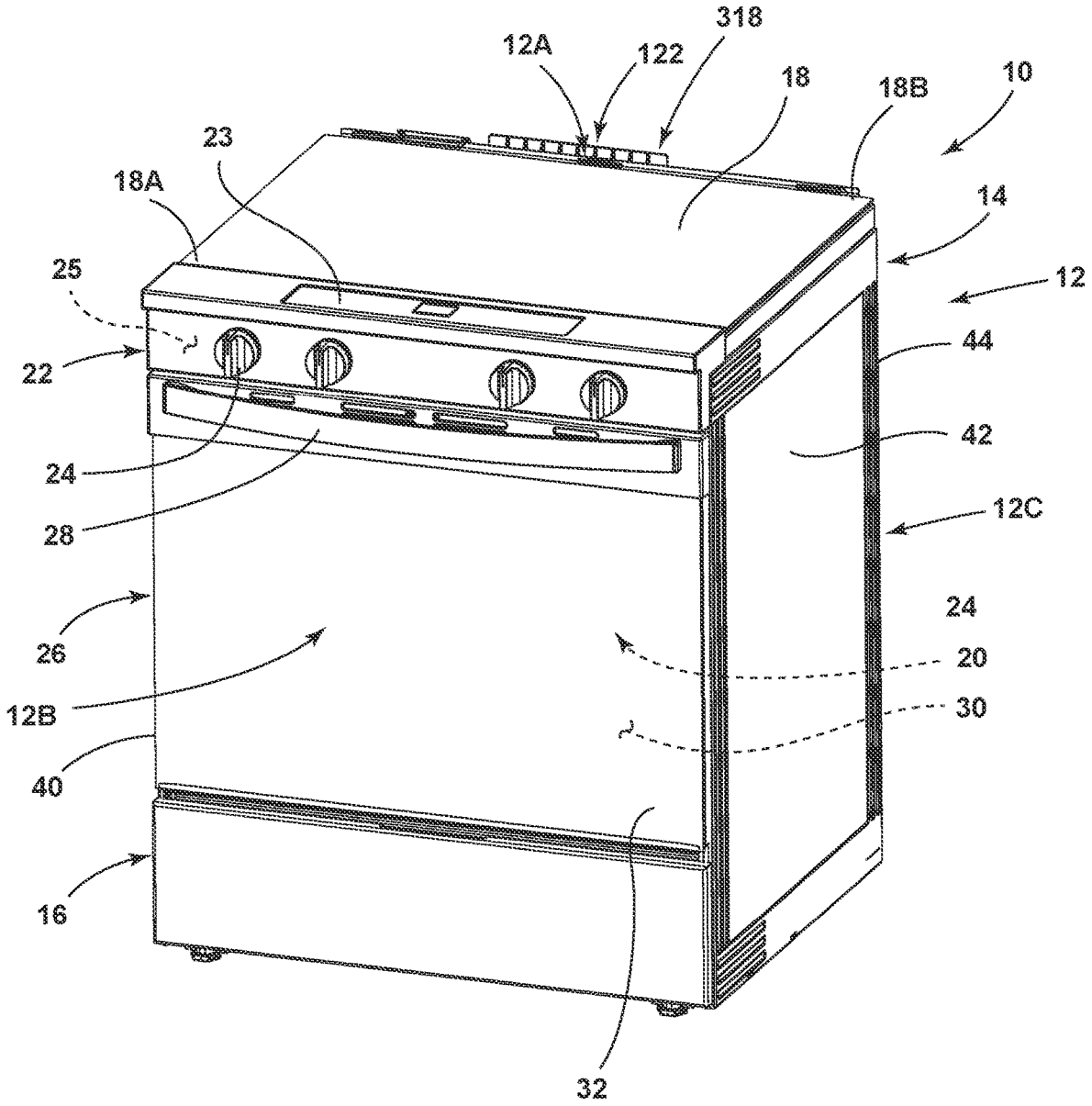
FIG. 1 is a front perspective view of a cooking appliance.

The components in the figures are not necessarily to scale, emphasis instead being placed upon illustrating the principles described herein.

DETAILED DESCRIPTION

The present illustrated embodiments reside primarily in combinations of method steps and apparatus components related to an integrated cooling system for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIG. 1, reference numeral 10 generally designates a cooking appliance shown in the form of a free-standing range appliance. According to the various embodiments, the cooking appliance 10 includes a housing 12 having a front portion 12B, a rear portion 12C, and a central upper rear portion 12A. The housing 12 further includes an upper portion 14, a lower portion 16 and a cooking cavity 20 disposed therebetween. The upper portion 14 includes a cooking surface 18 that is configured to support cookware over various style heat assemblies, which may be gas, induction or electric heat assemblies. The cooking surface 18 includes a front portion 18A and a rear portion 18B. The centrally disposed upper rear portion 12A of the housing 12 is shown in FIG. 1 as a designed location for venting air, as further described below. The upper portion 14 of the cooking appliance 10 further includes a control housing 22 having a display screen 23 and a plurality of knobs 24 for controlling operations of the heat assemblies of the cooking surface 18, as well as for controlling heat sources of the cooking cavity 20. The control housing 22 further includes an interior portion 25 for housing components of the control housing 22. The front portion 12B of the housing 12 further includes a door 26 operably coupled thereto. The door 26 is operable between open and closed positions for selectively providing access to the cooking cavity 20. The door 26 includes a handle 28 for engagement by a user in opening and closing the door 26. The door 26 further includes an interior portion 30 and an outer panel 32. The outer panel 32 of the door 26 may be a glass panel providing visibility into the cooking cavity 20.

The cooking cavity 20 includes at least one heat source that is in thermal communication with the cooking cavity 20. The heat source may include, but is not limited to, gas heat, convection heating, electrically resistive elements, electrically inductive elements, radiant heating, combinations thereof, and other similar heat sources for use within the cooking cavity 20 of the cooking appliance 10. Similarly, heat sources for the cooking surface 18 may include gas heat, electrically resistive elements, electrically inductive elements, radiant heating, combinations thereof, and other similar heat sources for use within the cooking surface 18 of the cooking appliance 10.

As further shown in FIG. 1, the housing 12 includes first and second sidewalls 40, 42 and a rear wall 44 that cooperate with the upper and lower portions 14, 16 of the housing 12 to surround the cooking cavity 20.

Figure 2:
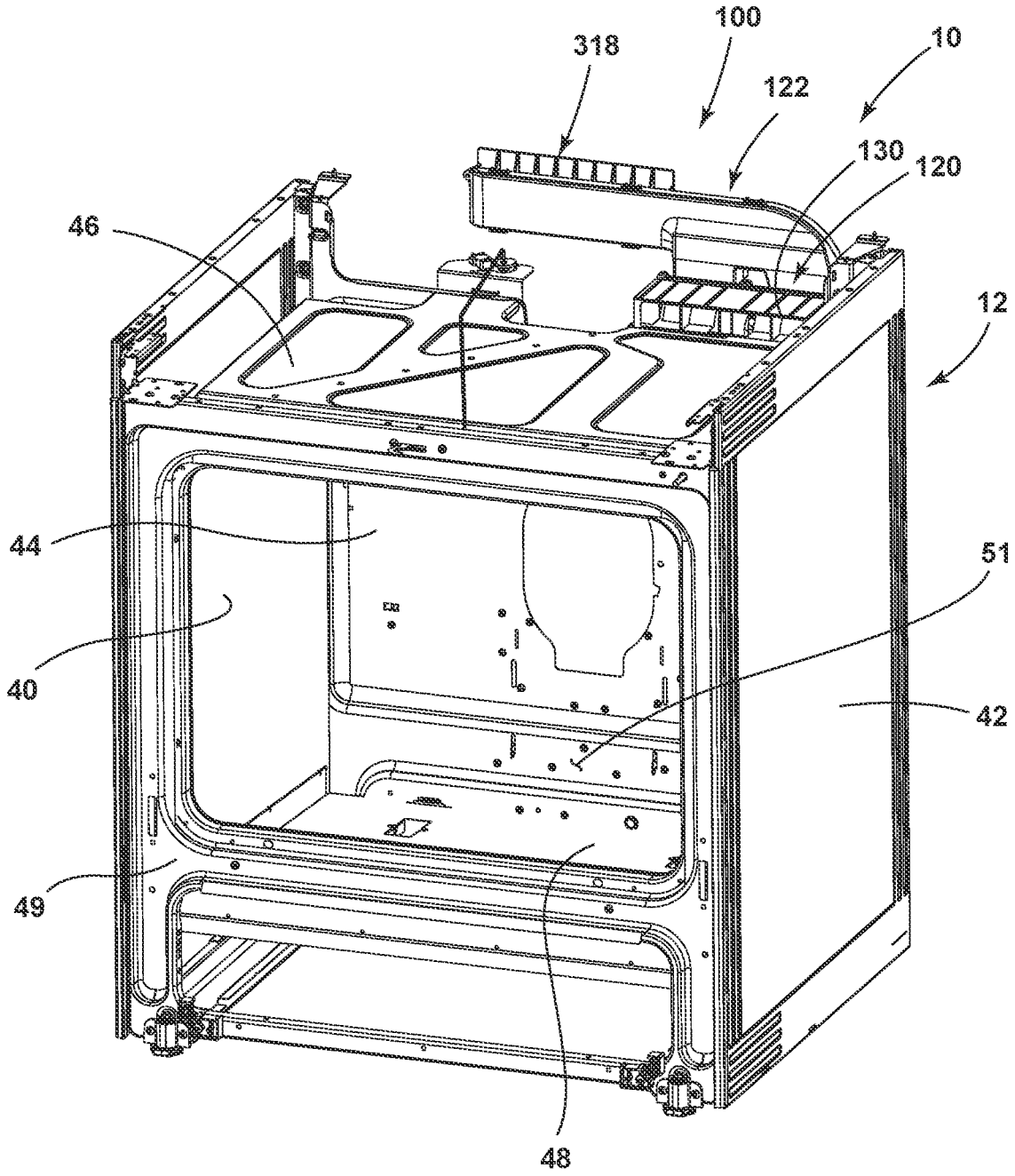
FIG. 2 is a front perspective view of the cooking appliance of FIG. 1 with portions thereof removed to reveal a housing and blower assembly.
Figure 3:
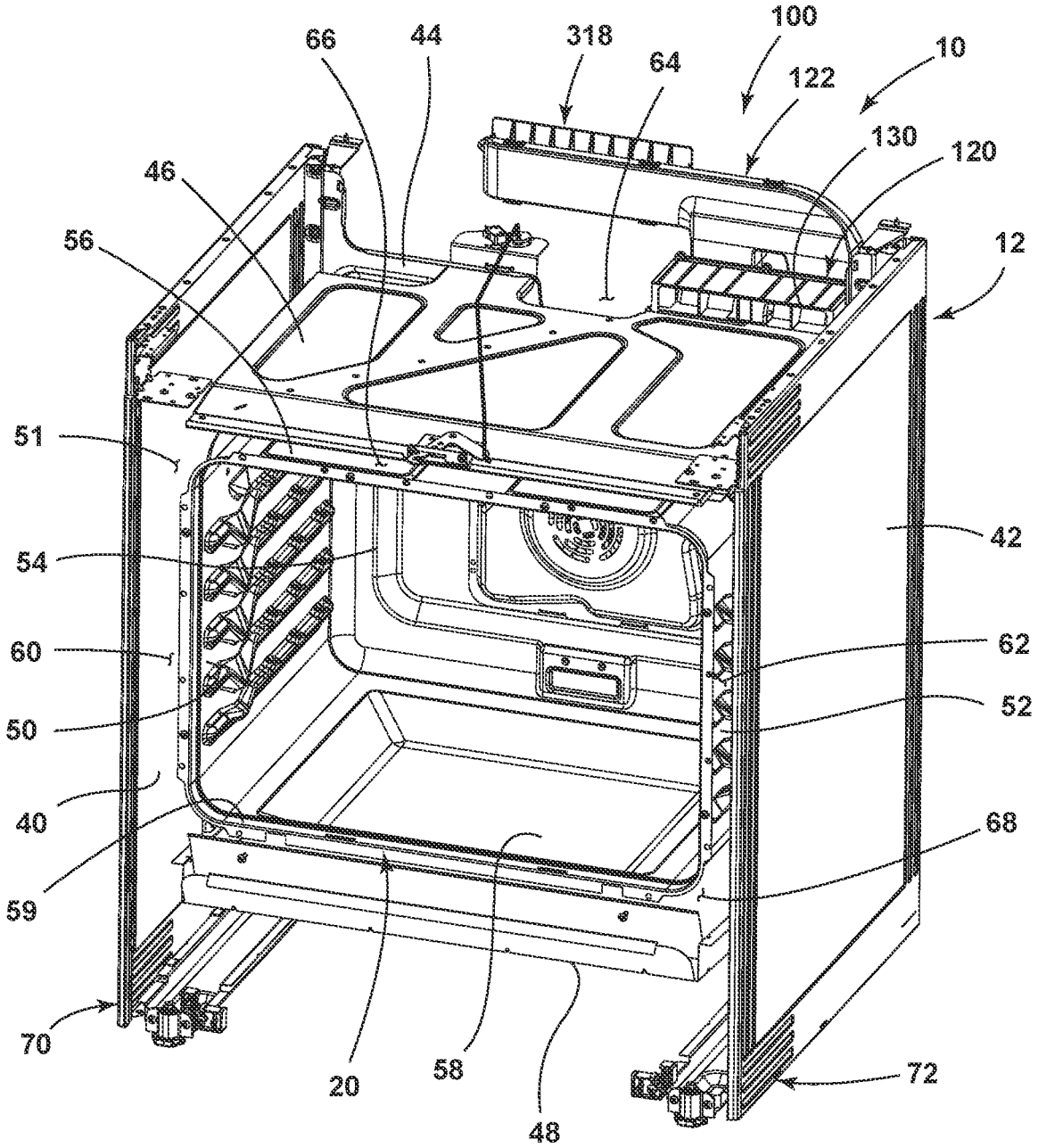
FIG. 3 is a front perspective view of the cooking appliance of FIG. 2 showing a cooking cavity received within the housing.

Referring now to FIG. 2, the door 26 and the upper and lower portions 14, 16 of the housing 12 have been removed to reveal other component parts of the housing 12. As shown in FIG. 2, the housing 12 further includes upper and lower walls 46, 48 and a front wall 49. The front wall 49 and the rear wall 44 are spaced-apart from one another and interconnected by the first and second sidewalls 40, 42 and the upper and lower walls 46, 48 to define a receiving area 51 in which the cooking cavity 20 is received, as shown in FIG. 3. As further shown in FIG. 2, with the upper portion 14 removed, a blower assembly 100 is revealed at the rear portion 12C of the housing 12 that is used to cool component parts of the cooking appliance 10, as further described below.

Referring now to FIG. 3, the front wall 49 has been removed, and the cooking cavity 20 is shown received in the receiving area 51 defined by the housing 12. The cooking cavity 20 includes first and second sidewalls 50, 52 that are spaced-apart from one another, and upper and lower walls 56, 58 that are spaced-apart from one another. The first and second sidewalls 50, 52 and the upper and lower walls 56, 58 of the cooking cavity 20 are interconnected with one another and surround a front opening 59 of the cooking cavity 20. The first and second sidewalls 50, 52 and the upper and lower walls 56, 58 of the cooking cavity 20 are also interconnected by a rear wall 54 of the cooking cavity 20. As shown in FIG. 3, the first sidewall 40 of the housing 12 and the first sidewall 50 of the cooking cavity 20 are spaced-apart from one another to define a first side channel 60. Similarly, the second sidewall 42 of the housing 12 and the second sidewall 52 of the cooking cavity 20 are spaced-apart from one another to define a second side channel 62. Further, the upper wall 46 of the housing 12 and the upper wall 56 of the cooking cavity 20 are spaced-apart from one another to define an upper channel 66, and the lower wall 48 of the housing 12 and the lower wall 58 of the cooking cavity 20 are spaced-apart from one another to define a lower channel 68. Further still, the rear wall 44 of the housing 12 and the rear wall 54 of the cooking cavity 20 are spaced-apart from one another to define a rear channel 64. Thus, the housing 12 surrounds the cooking cavity 20 and is spaced-apart from the cooking cavity 20 to define the plurality of channels 60, 62, 64, 66 and 68 disposed therebetween. Together, the plurality of channels 60, 62, 64, 66 and 68 surround the cooking cavity 20 and define air passageways for air to flow as drawn by the blower assembly 100, as further described below. As further shown in FIG. 3, the first and second sidewalls 40, 42 of the housing 12 include air inlets 70, 72, respectively, disposed at lower portions thereof, through which ambient air surrounding the cooking appliance 10 can be drawn into the plurality of channels 60, 62, 64, 66 and 68 and vented through the blower assembly 100 to cool components of the cooking appliance 10.

Figure 4:
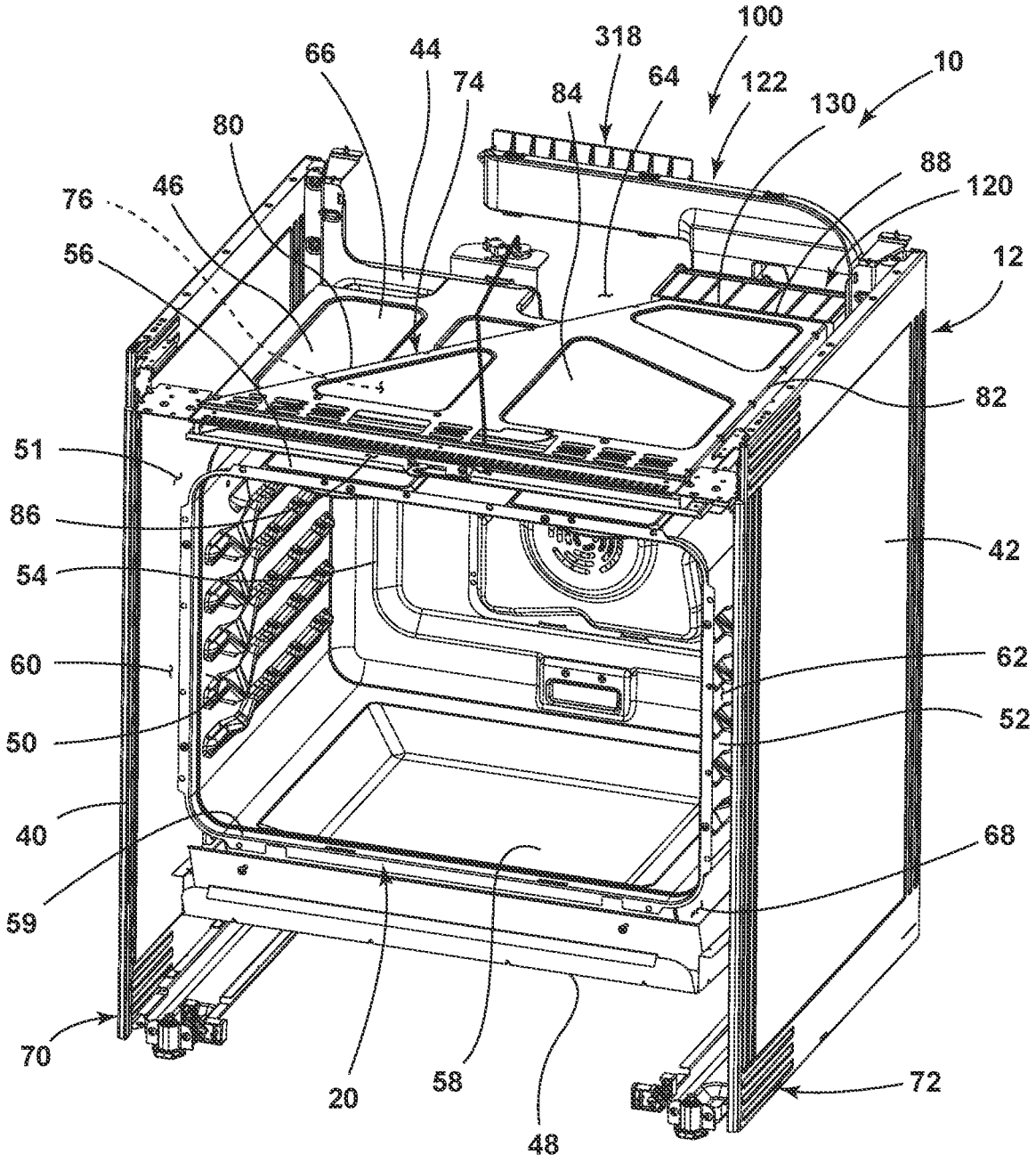
FIG. 4 is a front perspective view of the cooking appliance of FIG. 3 having a duct assembly received on an upper wall of the housing.

Referring now to FIG. 4, a duct assembly 74 is shown positioned on the upper wall 46 of the housing 12. The duct assembly 74 includes first and second sidewalls 80, 82 that upwardly extend from the upper wall 46 of the housing 12 and are interconnected by an upper wall 84. The first and second sidewalls 80, 82 and the upper wall 84 of the duct assembly 74 cooperate with the upper wall 46 of the housing 12 to define an interior cavity 76. The interior cavity 76 of the duct assembly 74 includes a front opening 86 and a rear opening 88, such that air can flow therethrough. Specifically, the front opening 86 of the interior cavity 76 of the duct assembly 74 opens into the upper portion 14 of the housing 12 while the rear opening 88 opens into the blower assembly 100 and is operably coupled thereto, such that air can be drawn through the front portion 12B to the rear portion 12C of the cooking appliance 10, as further described below.

Figure 5A:
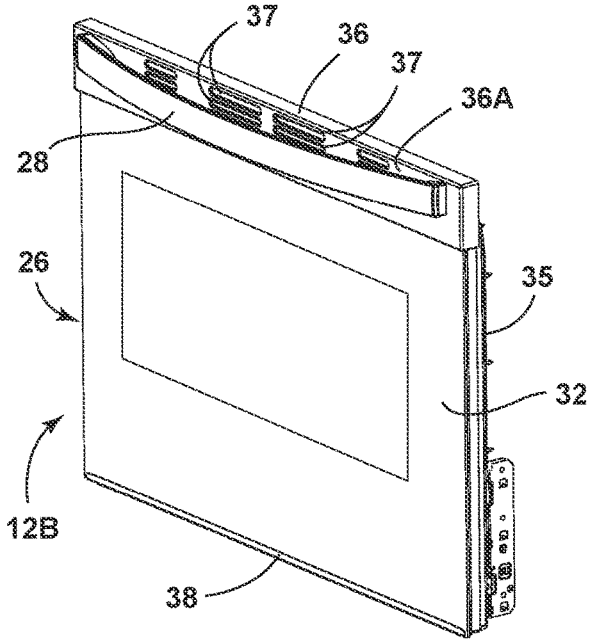
FIG. 5A is a front perspective view of a door of the cooking appliance of FIG. 1.

Referring now to FIG. 5A, the door 26 of the cooking appliance 10 is shown having the handle 28 thereof attached to an upper plate 36 of the door 26. The upper plate 36 of the door 26 includes a plurality of air inlets 37, which are forwardly opening inlets positioned behind the handle 28 on a vertical portion 36A of the upper plate 36. In this way, the handle 28 covers the plurality of air inlets 37 and conceals the plurality of air inlets 37 from a front elevation view. The door 26 further includes a support frame 35 and a lower plate 38 to which the outer panel 32 is coupled. The outer panel 32 is further coupled to the upper plate 36. Thus, the upper plate 36 and the lower plate 38 are positioned on opposite ends of the interior portion 30 of the door 26.

Figure 5B:
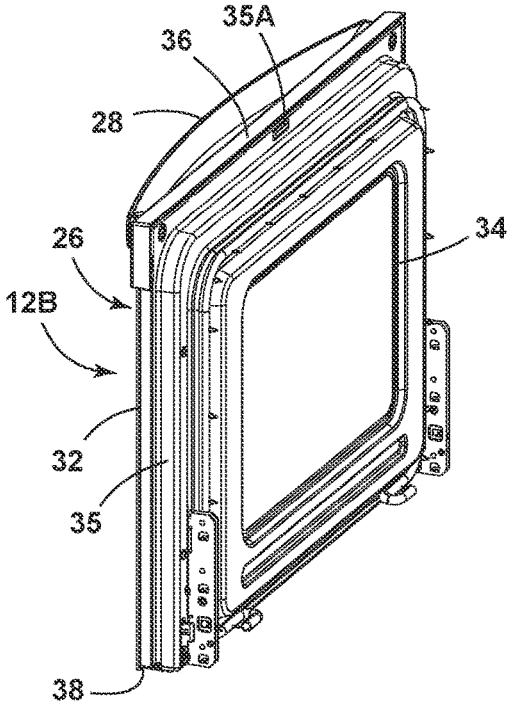
FIG. 5B is a rear perspective view of the door of FIG. 5A.

Referring now to FIG. 5B, the door 26 further includes an inner panel 34, which, much like the outer panel 32, may be comprised of a glass material to provide visibility into the cooking cavity 20 when the door 26 is in the closed position. The support frame 35 is shown surrounding perimeter portions of the door 26. The inner panel 34 is coupled to the support frame 35. The inner panel 34 and the outer panel 32 are spaced-apart from one another to define the interior portion 30 of the door 26.

Figure 5C:
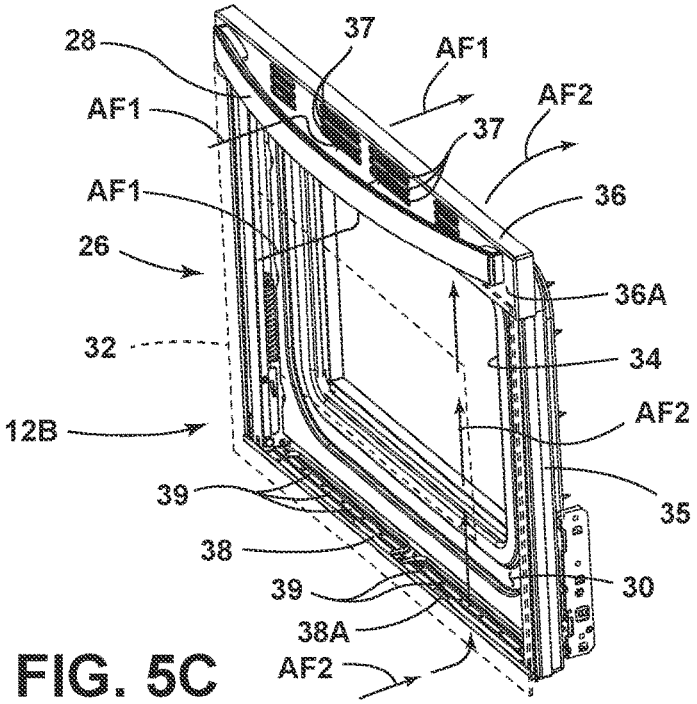
FIG. 5C is a front perspective view of the door of FIG. 5A with a front panel removed therefrom to reveal an interior of the door.

Referring now to FIG. 5C, the outer panel 32 has been removed to reveal the interior portion 30 of the door 26. As shown in FIG. 5C, the lower plate 38 of the door 26 includes a plurality of air inlets 39, which are downwardly opening inlets that are concealed from a front elevation view of the cooking appliance 10 as positioned through a horizontal portion 38A of the lower plate 38. In FIG. 5C, ambient air is configured to flow around the handle 28 through the plurality of air inlets 37 of the upper plate 36 and into an interior of the cooking appliance 10 as indicated by arrows AF1. Specifically, ambient air is drawn by the blower assembly 100 through the plurality of air inlets 37 of the upper plate 36 of door 26 both above and below the handle 28 as indicated by arrows AF1 due to an inlet configuration of the plurality of air inlets 37 of the upper plate 36 of the door 26. By flowing above and below the handle 28, ambient air cools the handle 28 during a cooking procedure. Further, ambient air is configured to flow upwardly through the plurality of air inlets 39 of the lower plate 38 into the interior portion 30 of the door 26 and continue through to the interior portion of the cooking appliance 10 as indicated by arrows AF2. The airflow AF1, AF2 indicated in FIG. 5C is provided to cool the handle 28 and the interior portion 30 of the door 26 to provide a more comfortable environment for a user when the cooking cavity 20 is being heated or when the cooking surface 18 is being used during a cooking procedure. The airflow is drawn through the door 26 by the blower assembly 100, as further described below. The air drawn through the plurality of air inlets 37, 39 may pass through interior portion 30 of the door 26 through an air outlet 35A disposed on the support frame 35, as shown in FIG. 5B, to the front opening 86 of the interior cavity 76 of the duct assembly 74. The air outlet 35A may also provide access for a lock mechanism for locking the door 26 in a closed position on the cooking appliance 10. With the air flowing through the interior portion 30 of the door 26, all components of the door 26 are cooled, including the inner and outer panels 32, 34, the handle 28, the support frame 35 and any components coupled thereto.

Figure 6A:
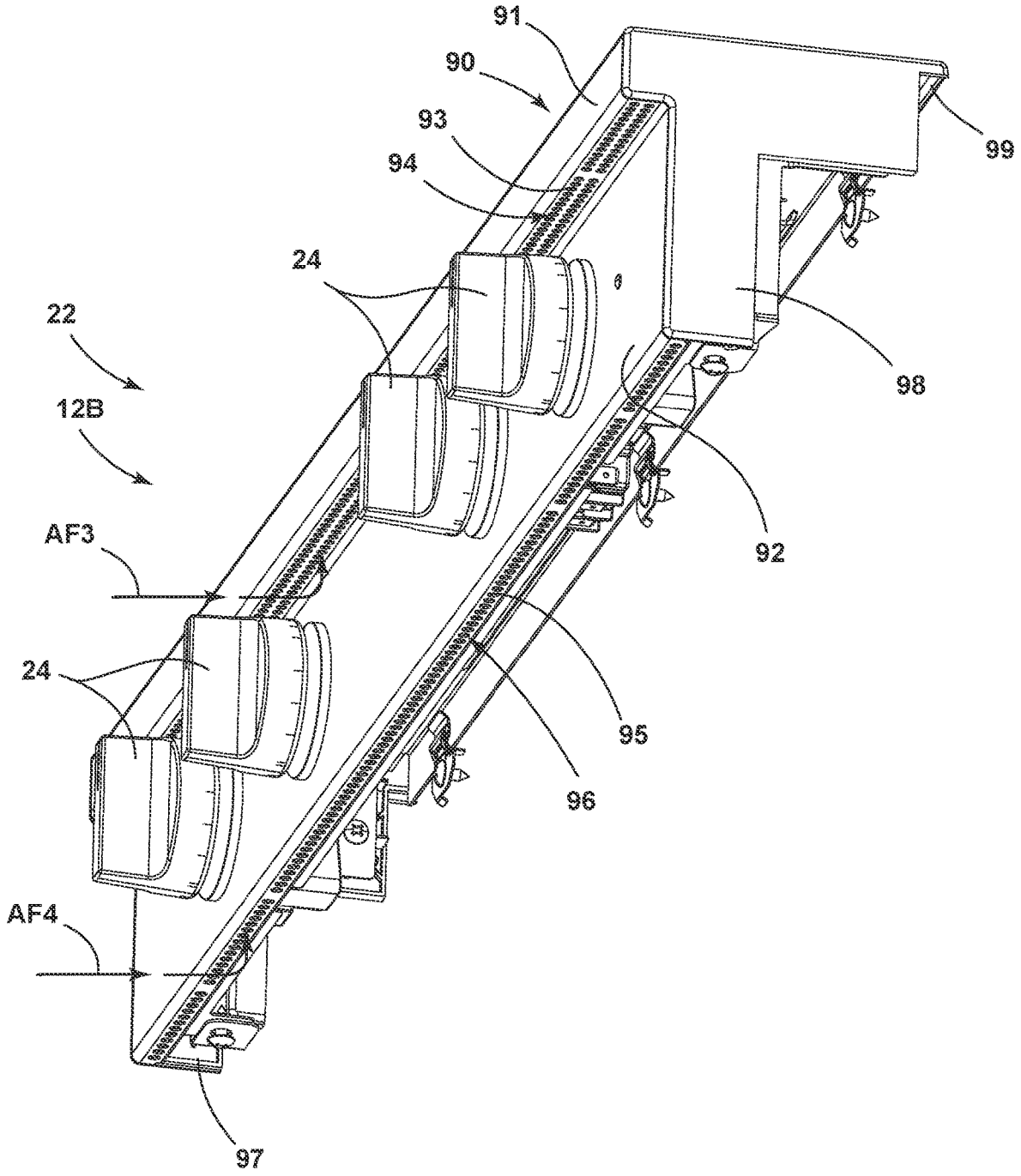
FIG. 6A is a bottom perspective view of a control housing of the cooking appliance of FIG. 1.
Figure 6B:
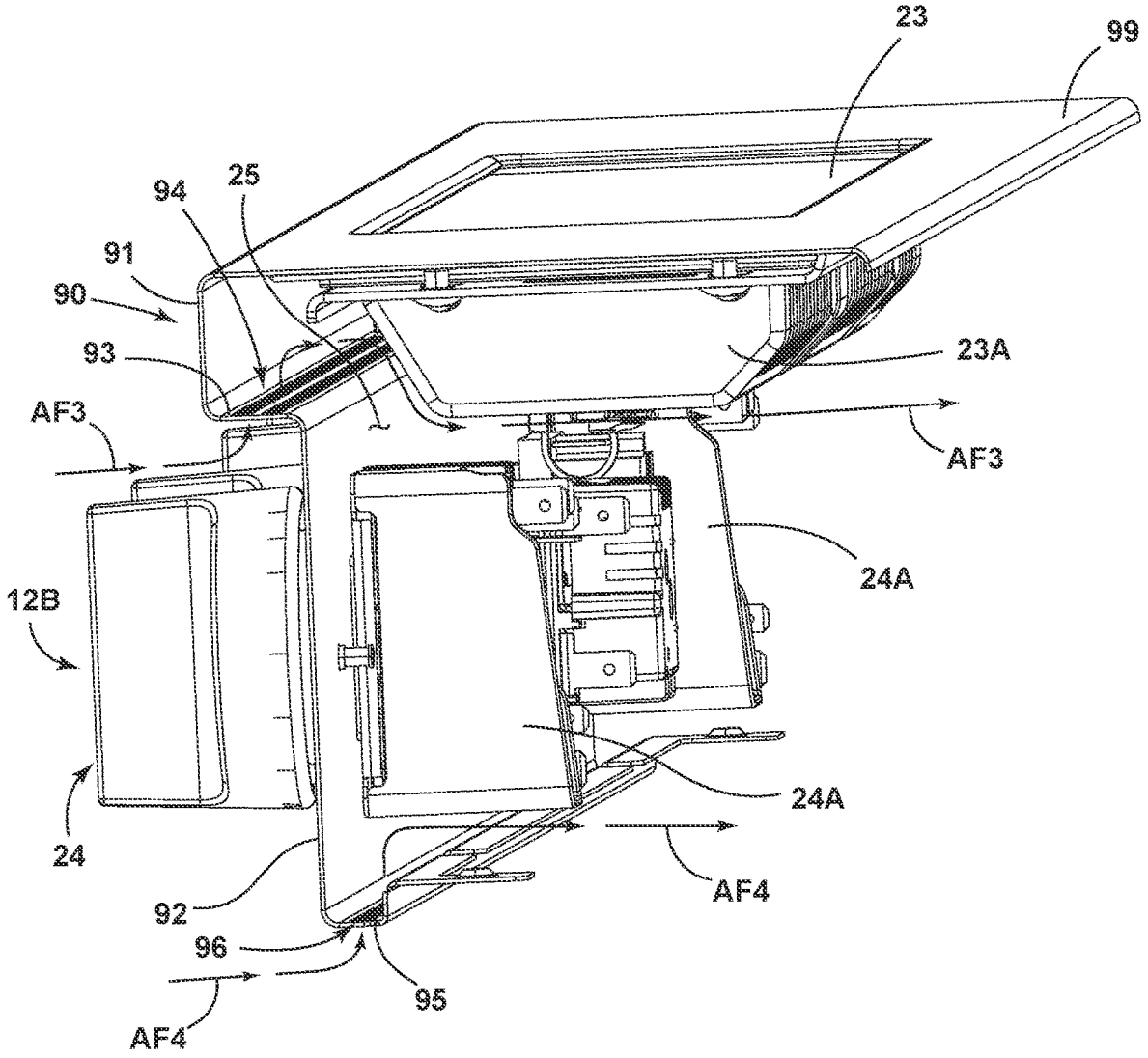
FIG. 6B is a rear perspective view of the control housing of FIG. 6A.
Figure 7A:
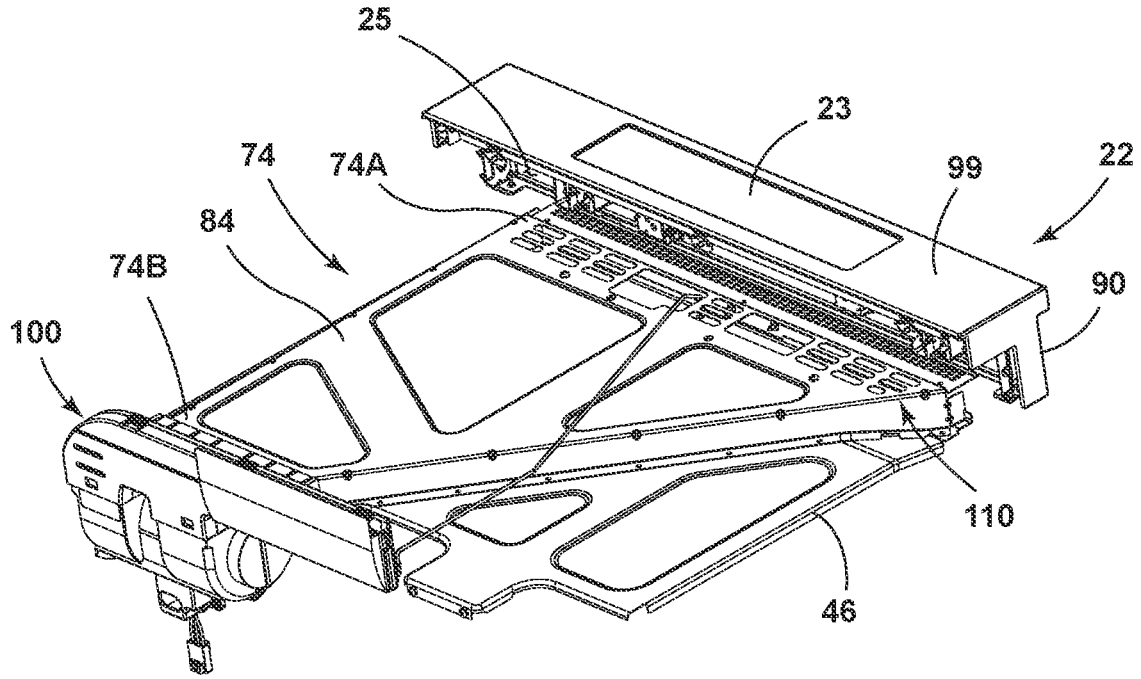
FIG. 7A is a rear perspective view of the control housing, duct assembly and blower assembly of the cooking appliance of FIG. 1.
Figure 7B:
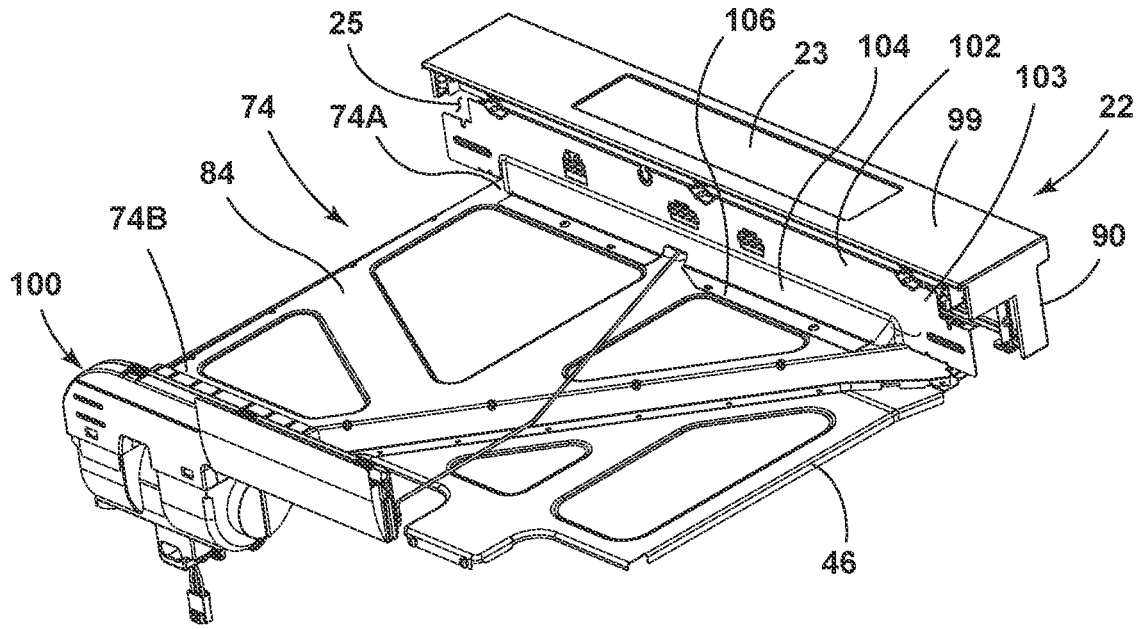
FIG. 7B is a rear perspective view of the control housing, duct assembly and blower assembly of FIG. 7A with a rear plate closing off the control housing.

Referring now to FIG. 6A, the control housing 22 is shown having a front panel 90. The front panel 90 includes a first vertical portion 91 and a second vertical portion 92 that are separated and interconnected by a first horizontal portion 93. In this way, the front panel 90 has a stepped configuration, such that the second vertical portion 92 is inwardly inset from the first vertical portion 91. The knobs 24 of the control housing 22 are positioned on the second vertical portion 92 of the front panel 90. A second horizontal portion 95 of the front panel 90 is provided at a lower portion of the second vertical portion 92. The first and second horizontal portions 93 and 95 of the front panel 90 each include a plurality of air inlets 94, 96, respectively, that allow for air to pass above and below the knobs 24 as illustrated in the direction as indicated by arrows AF3 and AF4. In this way, air drawn towards the plurality of air inlets 94, 96 can cool the knobs 24 when passing thereby. The air drawn through the plurality of air inlets 94, 96 may pass through the front panel 90 of the control housing 22 into the interior portion 25 of the control housing 22, and into the front opening 86 of the interior cavity 76 of the duct assembly 74, as best shown in FIGS. 6B and 7A, 7B. As illustrated in FIG. 6B the airflow indicated by arrows AF3 and AF4 further passes by interior component parts of the knobs 24 and the display screen 23 as positioned within the interior portion 25 of the control housing 22 to cool the same. Such components may include wire harnesses 24A, switches, circuit boards, display circuitry 23A and the like. Referring again to FIG. 6A, the control housing 22 includes first and second side panels 97, 98 and a top panel 99. As shown in FIG. 6B, the top panel 99 is a substantially horizontal panel on which the display screen 23 is disposed.

Referring now to FIG. 7A, the control housing 22 is shown positioned adjacent the upper wall 46 of the housing 12. The duct assembly 74 is positioned on the upper wall 46 of the housing 12 and includes a plurality of air inlets 110 disposed at a front portion 74A of the duct assembly 74. Specifically, the plurality of air inlets 110 is disposed through the upper wall 84 of the duct assembly 74, such that the plurality of air inlets 110 is positioned adjacent to the interior portion 25 of the control housing 22.

Referring now to FIG. 7B, the control housing 22 is shown having a rear plate 102. The rear plate 102 of the control housing 22 closes off the interior portion 25 of the control housing 22. The rear plate 102 of the control housing 22 includes a vertical portion 103 and an angled portion 104 that outwardly extends from the vertical portion 103. A mounting portion 106 extends in a horizontal manner from the angled portion 104 for coupling the rear plate 102 to the upper wall 84 of the duct assembly 74. The rear plate 102, and specifically the angled portion 104 thereof, covers the plurality of air inlets 110 disposed on the upper wall 84 of the duct assembly 74. In this way, air from the interior portion 25 of the control housing 22 can be pulled into and through the interior cavity 76 of the duct assembly 74, as drawn and vented out through the blower assembly 100 which is coupled to the rear portion 74B of the duct assembly 74.

Figure 8A:
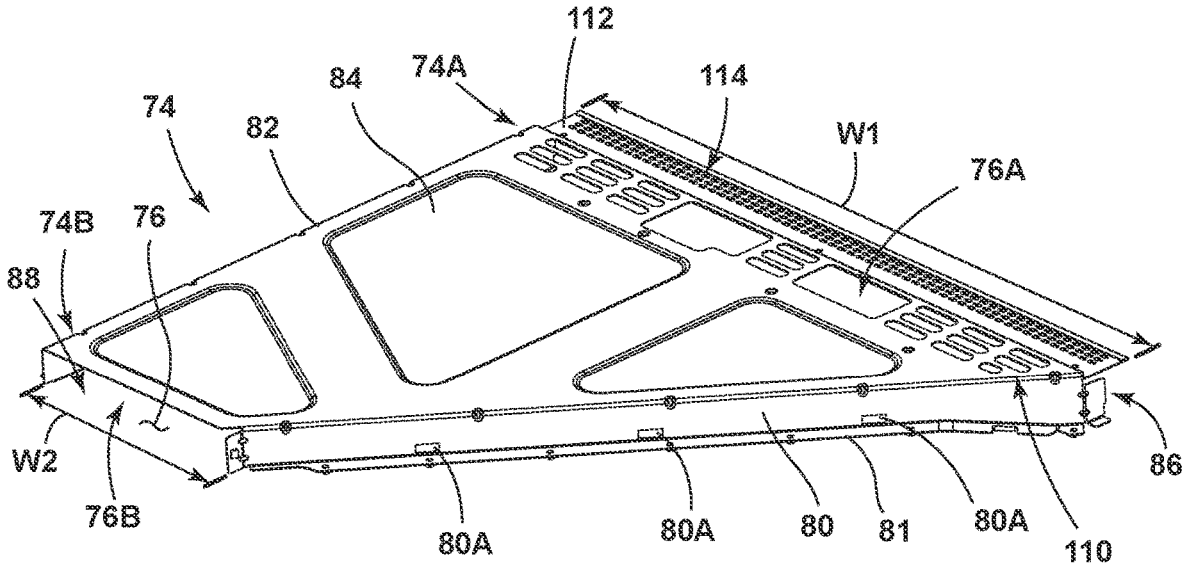
FIG. 8A is a rear perspective view of the duct assembly taken from a first side thereof.
Figure 8B:
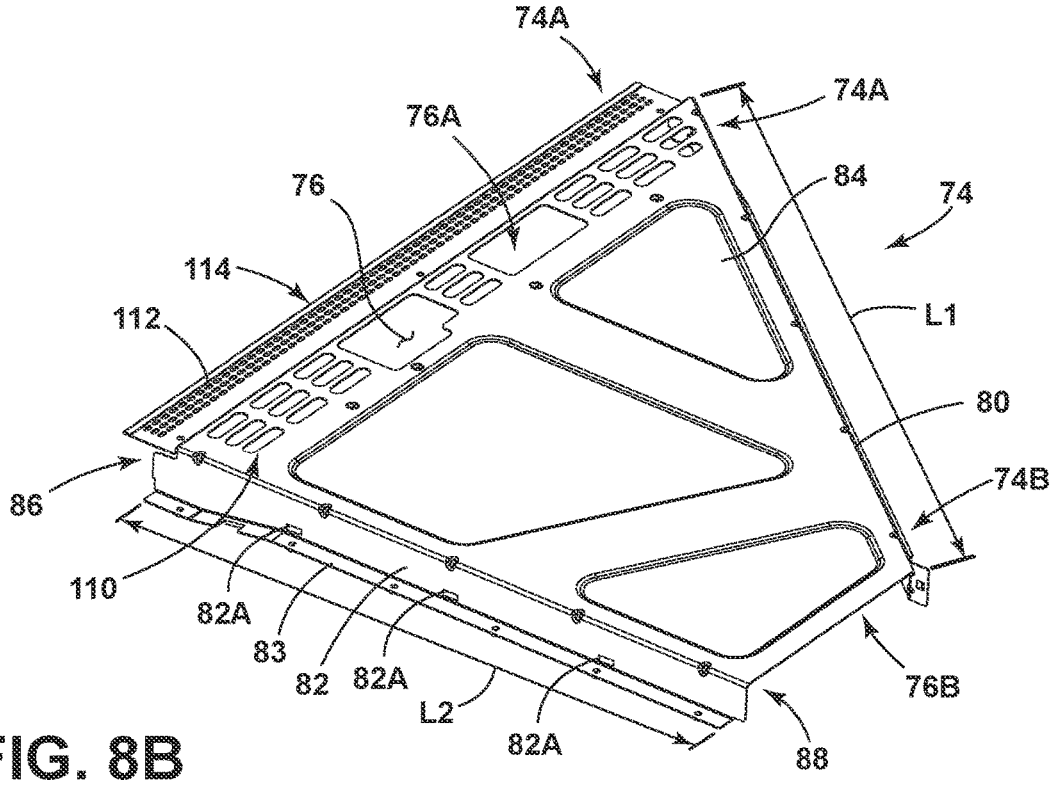
FIG. 8B is a rear perspective view of the duct assembly taken from a second side thereof.

Referring now to FIGS. 8A and 8B, the duct assembly 74 is shown from a top perspective view. The duct assembly 74 includes a near triangular configuration as first sidewall 80 is longer than second sidewall 82. The difference in the lengths of the sidewalls 80, 82 is due in part to the different widths of the front opening 86 and rear opening 88. The front opening 86 includes a width W1 that is greater than a width W2 of the rear opening 88 (FIG. 8A). Thus, the length L1 of the first sidewall 80 is greater than the length L2 of the second sidewall 82 of the duct assembly 74. As such, the interior cavity 76 is a tapered channel that tapers from the front portion 74A of the duct assembly 74 to the rear portion 74B of the duct assembly 74. As further shown in FIGS. 8A and 8B, a front flange 112 extends outwardly above the front opening 86 of the duct assembly 74. The front flange 112 includes a plurality of access apertures 114 which may be used as air inlets to permit airflow therethrough and into the interior cavity 76 of the duct assembly 74.

With specific reference to FIG. 8A, the first sidewall 80 of the duct assembly 74 includes a number of air inlets 80A that open into the interior cavity 76 of the duct assembly 74. The air inlets 80A are contemplated to be in fluid communication with the plurality of channels 60, 62, 64, 66 and 68 surrounding the cooking cavity 20 that define passageways for air to flow into the interior cavity 76 of the duct assembly 74 as drawn by the blower assembly 100. Specifically, the air inlets 80A are disposed adjacent to the first side channel 60 for drawing air therefrom. As further shown in FIG. 8A, the first sidewall 80 is a substantially vertical sidewall having a horizontal mounting flange 81 extending outwardly therefrom. The mounting flange 81 is used to mount the duct assembly 74 to the upper wall 46 of the housing 12.

With specific reference to FIG. 8B, the second sidewall 82 of the duct assembly 74 includes a number of air inlets 82A that open into the interior cavity 76 of the duct assembly 74. The air inlets 82A are also contemplated to be in communication with the plurality of channels 60, 62, 64, 66 and 68 surrounding the cooking cavity 20 that define passageways for air to flow into the interior cavity 76 of the duct assembly 74 as drawn by the blower assembly 100. Specifically, the air inlets 82A are disposed adjacent to the second side channel 62 for drawing air therefrom. As further shown in FIG. 8B, the second sidewall 82 is a substantially vertical sidewall having a horizontal mounting flange 83 extending outwardly therefrom. The mounting flange 83 is also used to mount the duct assembly 74 to the upper wall 46 of the housing 12.

Figure 9A:
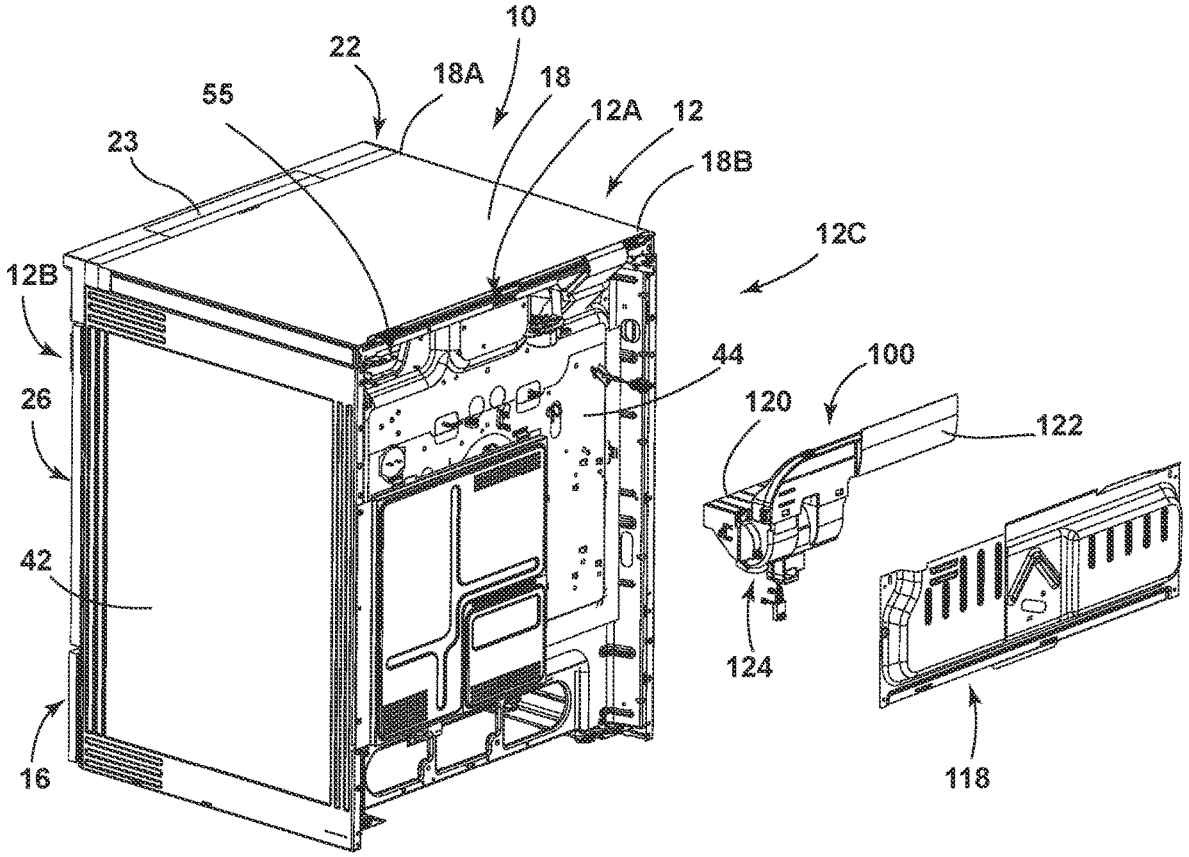
FIG. 9A is a rear perspective view of the cooking appliance of FIG. 1, with a trim panel and the blower assembly exploded away therefrom.
Figure 9B:
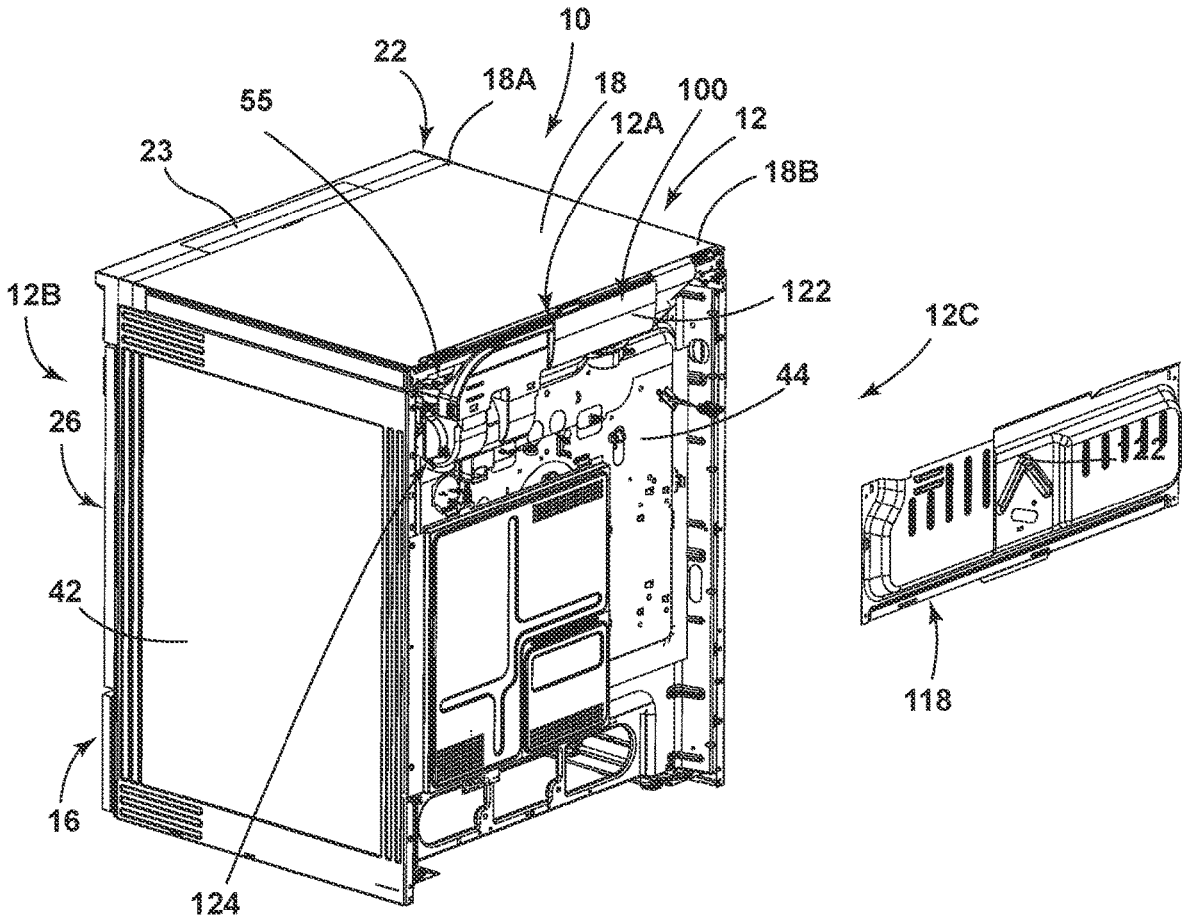
FIG. 9B is a rear perspective view of the cooking appliance of FIG. 9A with the blower assembly coupled to the cooking appliance.

Referring now to FIG. 9A, the cooking appliance 10 is shown from a rear perspective view with a rear trim panel 118 and the blower assembly 100 exploded away from the rear wall 54 of the housing 12. In assembly, the blower assembly 100 mounts to the rear wall 54 of the housing 12, such that an inlet 120 of the blower assembly 100 is received within the receiving aperture 55 of the rear wall 54 of the housing 12. The receiving aperture 55 of the rear wall 54 of the housing 12 aligns with the rear opening 88 of the duct assembly 74 described above. The blower assembly 100 further includes an outlet assembly 122 for exhausting air drawn through the housing 12 by the blower assembly 100. Air is drawn through the blower assembly 100 by motors positioned within a motor housing 124 of the blower assembly 100 that is configured between the inlet 120 and the outlet assembly 122. When mounted to the housing 12, as shown in FIG. 9B, the blower assembly 100 is configured such that the outlet assembly 122 is positioned at the central upper rear portion 12A of the housing 12 adjacent the rear portion 18B of the cooking surface 18. The outlet assembly 122 can also be seen located at this central upper rear portion 12A of the housing 12 in FIG. 1. In this way, the outlet assembly 122 of the blower assembly 100 is symmetrically concentrated towards the central upper rear portion 12A of the cooking appliance 10. This symmetry generates a uniform, continuous high-speed airflow curtain to protect adjacent walls or cabinetry positioned behind the cooking appliance 10 as installed from the effect of low-pressure zones that can drag hot air generated by the combustions of the cooking surface 18 down towards the protect adjacent walls or cabinetry. Thus, the cooling system of the cooking appliance 10 allows an increase in power of the burners of the cooking surface 18, while still being compliant with regulatory requirements and without compromising the overall design intent of the cooking appliance 10.

Figure 10A:
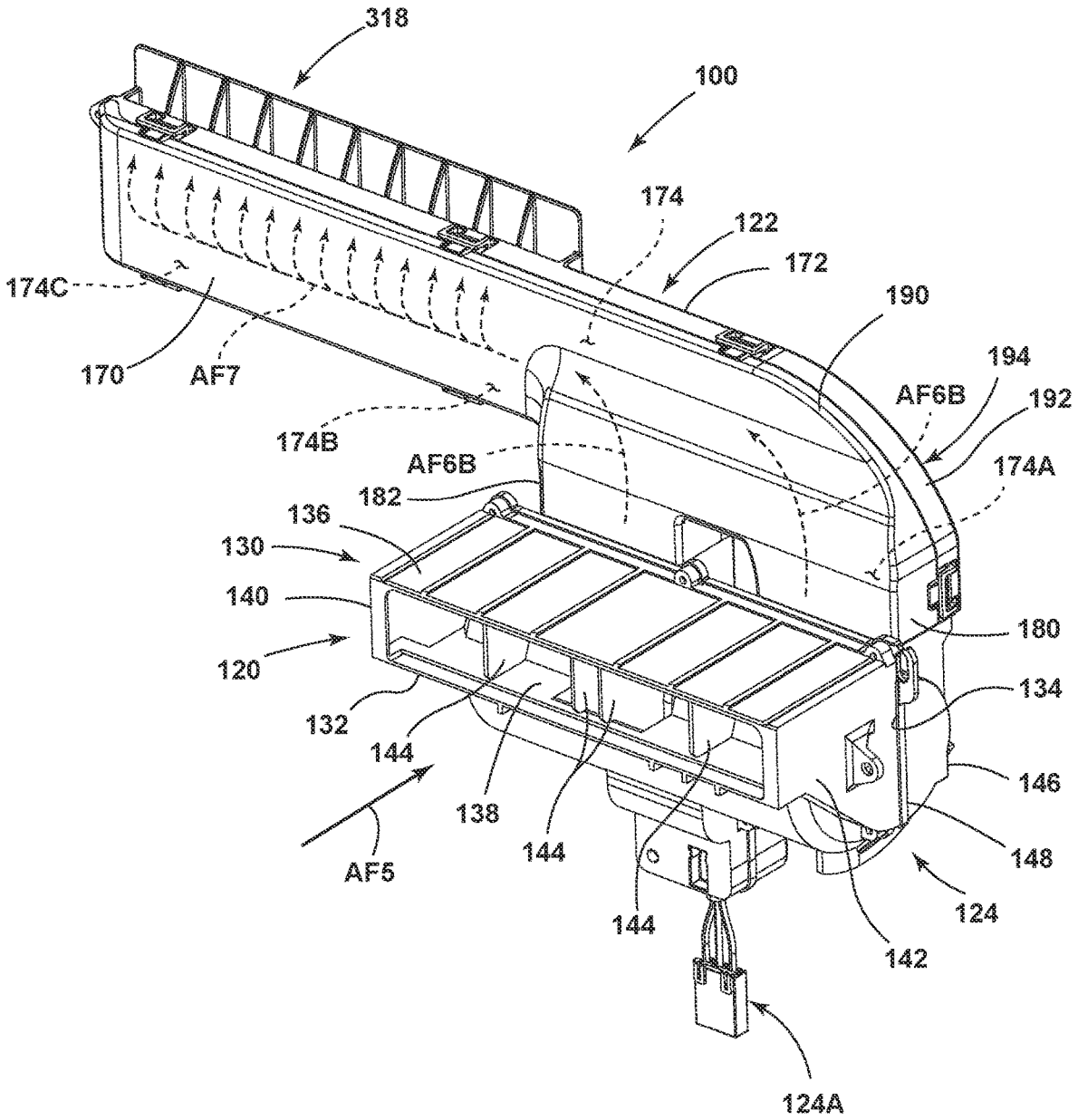
FIG. 10A is a front perspective view of the blower assembly.

Referring now to FIG. 10A, the inlet 120 of the blower assembly 100 includes an inlet housing 130 having a front opening 132 and a rear opening 134. The inlet housing 130 further includes a top wall 136 and a bottom wall 138 that are spaced-apart from one another and interconnected by first and second sidewalls 140, 142 disposed on opposite ends of the inlet housing 130. The top wall 136 and the bottom wall 138 are further interconnected by a plurality of baffles 144 disposed in a vertical configuration along the front opening 132. As shown in FIG. 10A, the inlet 120 is configured to horizontally receive air along the path indicated by arrow AF5 through the front opening 132 of the inlet housing 130. Specifically, the front opening 132 of the inlet 120 of the blower assembly 100 is in fluid communication with the rear opening 88 of the duct assembly 74, such that air is drawn through the interior cavity 76 of the duct assembly 74 to the front opening 132 of the inlet 120 of the blower assembly 100 in a horizontal manner.

Figure 10B:
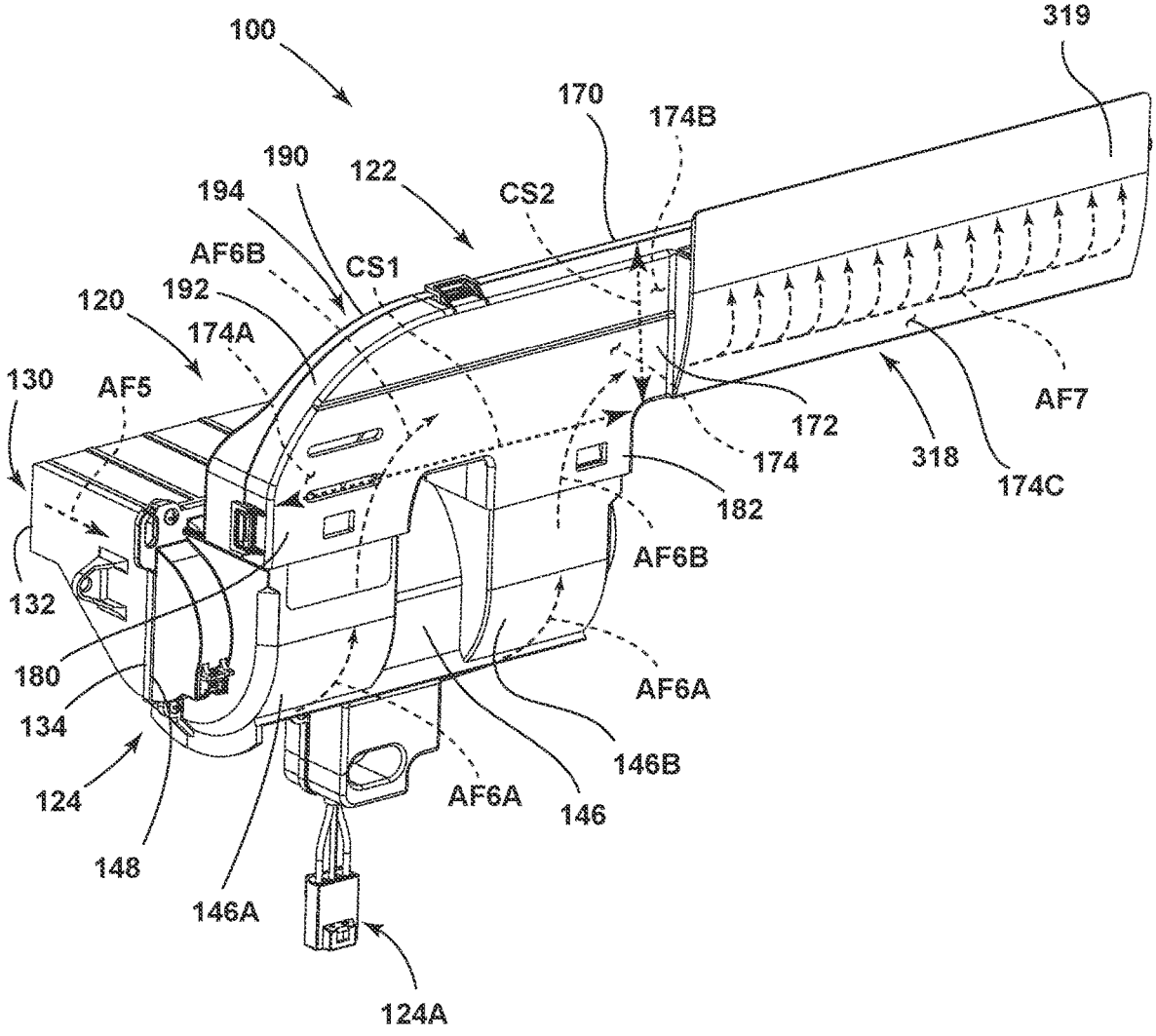
FIG. 10B is a rear perspective view of the blower assembly of FIG. 10A.
Figure 11:
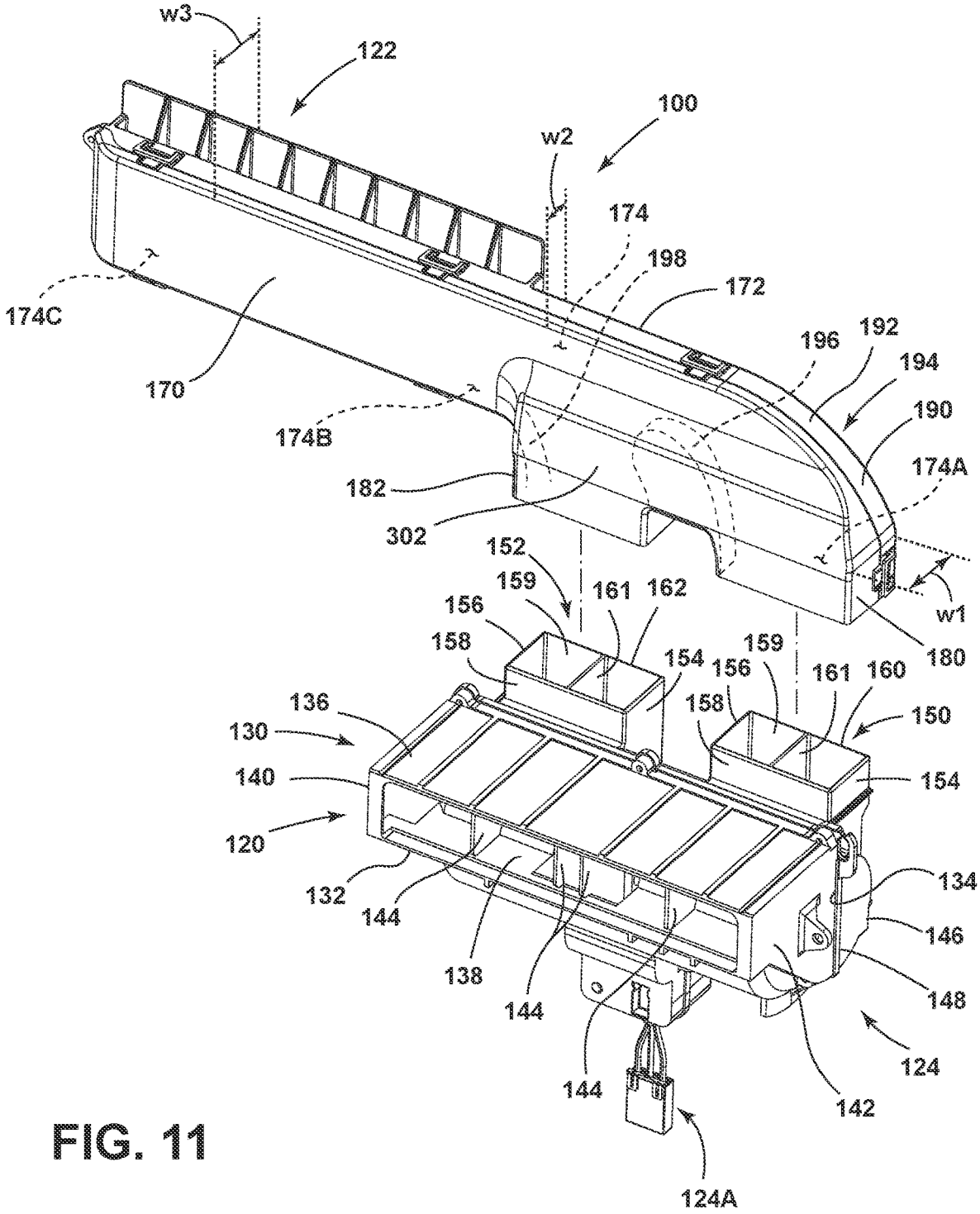
FIG. 11 is a front perspective view of the blower assembly with an outlet exploded away from an inlet and motor housing.

Referring now to FIG. 10B, the motor housing 124 of the blower assembly 100 includes a body portion 146 having a front opening 148 and first and second rear outlets 150, 152 (FIG. 11). The body portion 146 includes first and second upwardly curved portions 146A, 146B that culminate in the first and second rear outlets 150, 152, respectively. The first and second upwardly curved portions 146A, 146B help to direct air in an upward direction as indicated by arrows AF6A towards the outlet assembly 122 of the blower assembly 100. Thus, air enters the blower assembly 100 through the inlet 120 to provide for airflow AF5 directed in a horizontal manner through the inlet 120. The inlet 120 is in fluid communication with the motor housing 124. Specifically, as shown in FIG. 10B, the front opening 148 of the motor housing 124 is coupled to the rear opening 134 of the inlet 120 to provide airflow AF5 through the inlet 120 to the motor housing 124. The entering airflow AF5 is then directed upwards as indicated by arrows AF6A towards the outlet assembly 122. Thus, the first and second upwardly curved portions 146A, 146B of the motor housing 124 guide the airflow from the horizontal direction of the inlet 120 (see airflow AF5) to a vertical direction as indicated by airflow AF6A. The motor housing 124 includes a wire harness 124A for providing power to a motor 314 that powers rotation of blowers 310, 312 (FIG. 12B) that are housed within the motor housing 124. The blowers 310, 312 draw the ambient air around the cooking appliance 10 into the blower assembly 100 and further power air though the outlet assembly 122 as further described below.

Referring now to FIG. 11, the outlet assembly 122 of the blower assembly 100 is shown exploded away from the first and second rear outlets 150, 152 of the motor housing 124. The first and second rear outlets 150, 152 of the motor housing 124 each include first and second sidewalls 154, 156 that are spaced-apart from one another and interconnected by front and rear walls 158, 159 to define first and second air outlets 160, 162 that are upwardly extending. The first and second air outlets 160, 162 each include a divider plate 161 that interconnects the front and rear walls 158, 159 thereof, and divides the first and second air outlets 160, 162.

With further reference to FIGS. 10A and 10B, the outlet assembly 122 of the blower assembly 100 includes front and rear panels 170, 172 which are coupled to one another to define an interior channel 174 therebetween. The interior channel 174 has varying cross-sections over portions thereof. For instance, the interior channel 174 includes a first portion 174A that includes first and second inlets 176A, 176B that come together to define a first cross-section or width CS1 that is horizontally disposed and substantially perpendicular to the vertical direction of airflow as shown by arrows AF6B. In connecting the motor housing 124 with the outlet assembly 122 of the blower assembly 100, the first and second rear outlets 150, 152 of the motor housing 124 are received in the first and second inlets 176A, 176B of the outlet assembly 122, as shown in FIGS. 10A and 10B. Thus, air flows through the divided or baffled first and second air outlets 160, 162 of the motor housing 124 into undivided inlets defined by the first and second inlets 176A, 176B of the outlet assembly 122. A second portion 174B of the interior channel 174 includes a second cross-section or width CS2 that is vertically disposed and substantially perpendicular to the horizontal direction of airflow as shown by arrows AF6B. The second cross-section or width CS2 is smaller than the first cross-section or width CS1. It is contemplated that the second cross-section or with CS2 may be 50% the width of the first cross-section or width CS1, or less. This restriction from the first portion 174A of the interior channel 174 to the second portion 174B of the interior channel 174 creates an acoustic impedance mismatch that reflects part of the forward traveling component of the airflow inducing noise and muffles or reduces the amplitude of the soundwave. In this way, the outlet assembly 122 is designed to increase the back pressure of the air flowing through the interior channel 174 which will reduce the overall noise of the air passing through the outlet assembly 122. Thus, the design of the outlet assembly 122 of the blower assembly 100 creates an acoustic impedance mismatch along with reduced airflow rate and increased back pressure to help reduce the overall noise produced by the blower assembly 100.

As referenced above, the entering airflow AF5 from the duct assembly 74 is drawn horizontally towards the motor housing 124 where it is then directed upwards in a vertical direction by the first and second upwardly curved portions 146A, 146B of the motor housing 124 as indicated by airflow AF6A towards the first portion 174A of the interior channel 174 of the outlet assembly 122. As noted above, the first portion 174A of the interior channel 174 includes a first cross-section CS1. The outlet assembly 122 further includes an outer deflector 194 (FIGS. 10A-12B) that is comprised of inwardly curved portions 190, 192 of the front and rear panels 170, 172, respectively, that cooperate to define an inwardly curved contact surface 195 of outer deflector 194. As such, the outer deflector 194 includes an inwardly curved radius along the inwardly curved contact surface 195 that contacts and directs the air being propelled along a first vertical airflow path, as indicated by arrows AF6A, towards the central upper rear portion 12A of the housing 12 along a horizontal airflow path as indicated by arrows AF6B. From the horizontal airflow path indicated by arrows AF6B, the air is further propelled to a second vertical airflow path as indicated by arrows AF7 exiting the outlet assembly at the rear air outlet 318. Thus, the airflow pathways indicated by arrows AF1-AF5 are drawn from the front portion 12B of the cooking appliance 10 to the blower assembly 100 which is positioned at the rear portion 12C of the cooking appliance 10. The airflow pathways indicated by arrows AF6A-AF7 are propelled through the outlet assembly 122 by the blowers 310, 312 of the blower assembly 100.

Figure 12A:
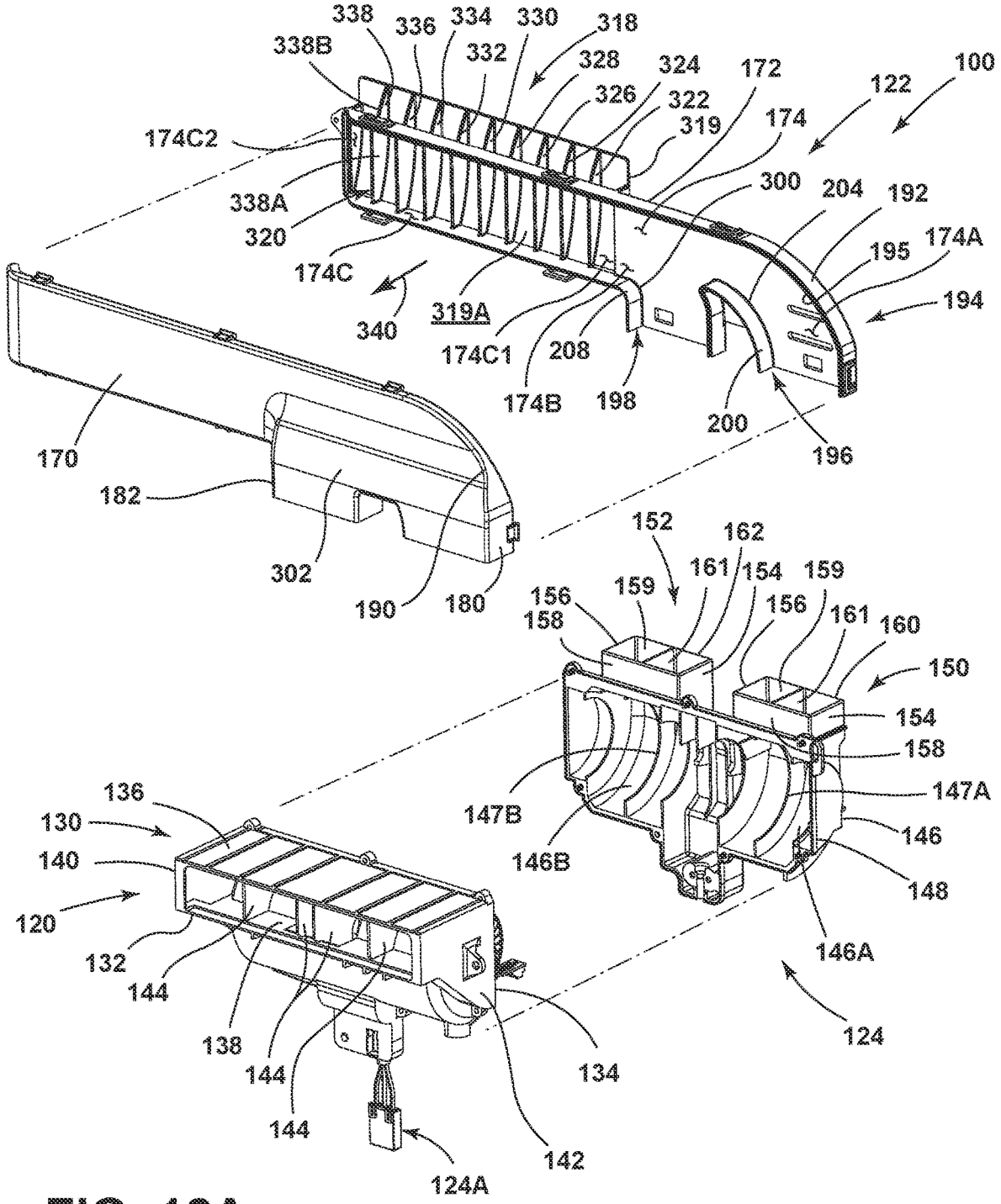
FIG. 12A is an exploded front perspective view of the blower assembly.
Figure 12B:
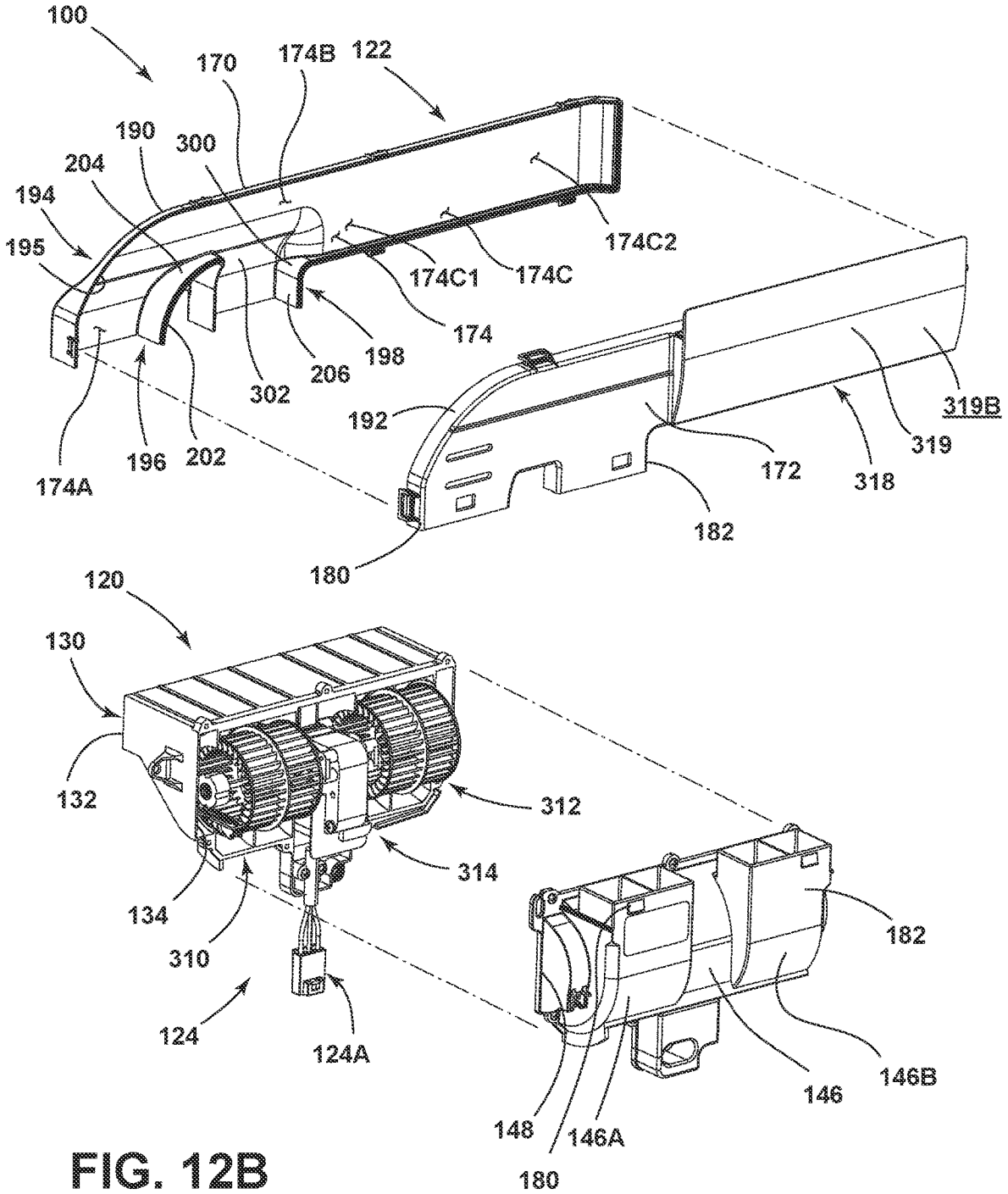
FIG. 12B is an exploded rear perspective view of the blower assembly of FIG. 12A.

With reference to FIGS. 11-12B, the first portion 174A of the interior channel 174 further includes first and second inner deflectors 196, 198 that cooperate with the outer deflector 194 to direct the vertical airflow AF6A coming from the first and second rear outlets 150, 152 of the motor housing 124 and guide the same to the horizontal airflow path AF7. The first inner deflector 196 includes first and second portions 200, 202 disposed on the front and rear panels 170, 172, respectively, that cooperate to define the first inner deflector 196. The first and second portions 200, 202 of the first inner deflector 196 define an inwardly curved contact surface 204 that contacts and guides the vertical airflow AF6A towards the central upper rear portion 12A of the housing 12 along the airflow path as indicated by arrows AF6B to a horizontal airflow path AF7. As such, the first inner deflector 196 and the outer deflector 194 work in concert to redirect the airflow from airflow AF6A to airflow AF6B, which then leads to airflow AF7. Similarly, the second inner deflector 198 includes first and second portions 206, 208 disposed on the front and rear panels 170, 172, respectively, that cooperate to define the second inner deflector 198. The first and second portions 206, 208 of the second inner deflector 198 define an inwardly curved contact surface 300 that contacts and directs the vertical airflow AF6A towards the central upper rear portion 12A of the housing 12 along the airflow path as indicated by arrows AF6B to a horizontal airflow path AF7. As such, the first and second inner deflectors 196, 198 and the outer deflector 194 all work in concert to redirect the airflow from airflow AF6A to airflow AF6B, which then leads to airflow AF7.

As shown in FIG. 11, the front panel 170 the outlet assembly 122 includes an angled wall portion 302 disposed at the first portion 174A of the interior channel 174 that narrows the width of the interior channel 174 from a first width w1 disposed at the first portion 174A of the interior channel 174, to a second width w2 disposed at the second portion 174B of the interior channel 174. This narrowing of the interior channel 174 from the first portion 174A to the second portion 174B provides for a Venturi effect that may increase the speed of the airflow from the first portion 174A to the second portion 174B of the interior channel. The angled wall portion 302 of the outlet assembly 122 is an outwardly angled wall portion that is angled away from the cooking appliance 10.

As further shown in FIGS. 10A and 10B, the interior channel 174 of the outlet assembly 122 includes a third portion 174C culminating in a rear air outlet 318. The rear air outlet 318 is an upwardly opening outlet that is positioned at the centrally disposed upper rear portion 12A of the housing 12. All air drawn by the blower assembly 100 exits the cooking appliance 10 through the rear air outlet 318 of the outlet assembly 122.

As shown in FIG. 12A, a plurality of baffles 320 is positioned within the third portion 174C of the interior channel 174. The plurality of baffles 320 includes individual baffles 322, 324, 326, 328, 330, 332, 334, 336 and 338 (hereinafter baffles 322-338) that are spaced-apart from one another from a first end 174C1 of the third portion 174C of the interior channel 174 to a second end 174C2 of the third portion 174C of the interior channel 174. The baffles 322-338 of the plurality of baffles 320 are vertically positioned along an interior surface 319A of an upwardly curved wall 319 of the air outlet 318. The baffles 322-338 of the plurality of baffles 320 inwardly extend into the third portion 174C of the interior channel 174 from the interior surface 319A of the upwardly curved wall 319 in the direction as indicated by arrow 340. Thus, each baffle 322-338 of the plurality of baffles 320 is positioned in a rear-to-front extending direction as indicated by arrow 340. Specifically, the plurality of baffles 320 are configured in a progressively inwardly extending configuration. Said differently, the plurality of baffles includes serially aligned baffles 322-338 that inwardly extend into the third portion 174C of the interior channel 174 to a progressively increasing extent. The extent to which a baffle extends into the third portion 174C of the interior channel 174 increases from a first end 174C1 of the third portion 174C of the interior channel 174 to a second end 174C2 of the third portion 174C of the interior channel 174. Thus, being the last baffle positioned at the second end 174C2 of the third portion 174C of the interior channel 174 of the outlet assembly 122, baffle 338 extends the furthest into the third portion 174C of the interior channel 174. Similarly, being the first baffle positioned at the first end 174C1 of the third portion 174C of the interior channel 174 of the outlet assembly 122, baffle 322 extends the least into the third portion 174C of the interior channel 174. Each baffle 324-338 after baffle 322 extends further into the third portion 174C of the interior channel 174 of the outlet assembly 122 as moving from the first end 174C1 to the second end 174C2 of the third portion 174C of the interior channel 174 in a progressive manner. Together, the plurality of baffles 320 guides the airflow from the horizontal path indicated by arrow AF6B to the vertical airflow path indicated by arrows AF7.

As further shown in FIG. 12A, the baffles 322-338 include upper and lower portions. With specific reference to baffle 338, the description of which will also describe baffles 322-336, the upper portion 338A thereof extends upwardly above the third portion 174C of the interior channel 174. In this way, the upper portion 338A is positioned outside of the interior channel 174 of the outlet assembly 122. The lower portion 338B of the baffle 338 is disposed within the third portion 174C of the interior channel 174, such that the lower portion 338B of baffle 338 extends inwardly into the interior channel 174 at the third portion 174C thereof. The extension of the upper portion 338A of baffle 338 helps to further guide airflow in the vertical direction as indicated by arrow AF7.

As shown in FIG. 12B, the upwardly curved wall 319 of the rear air outlet 318 includes an exterior surface 319B that is opposed to the interior surface 319A as shown in FIG. 12A.

Figure 13:
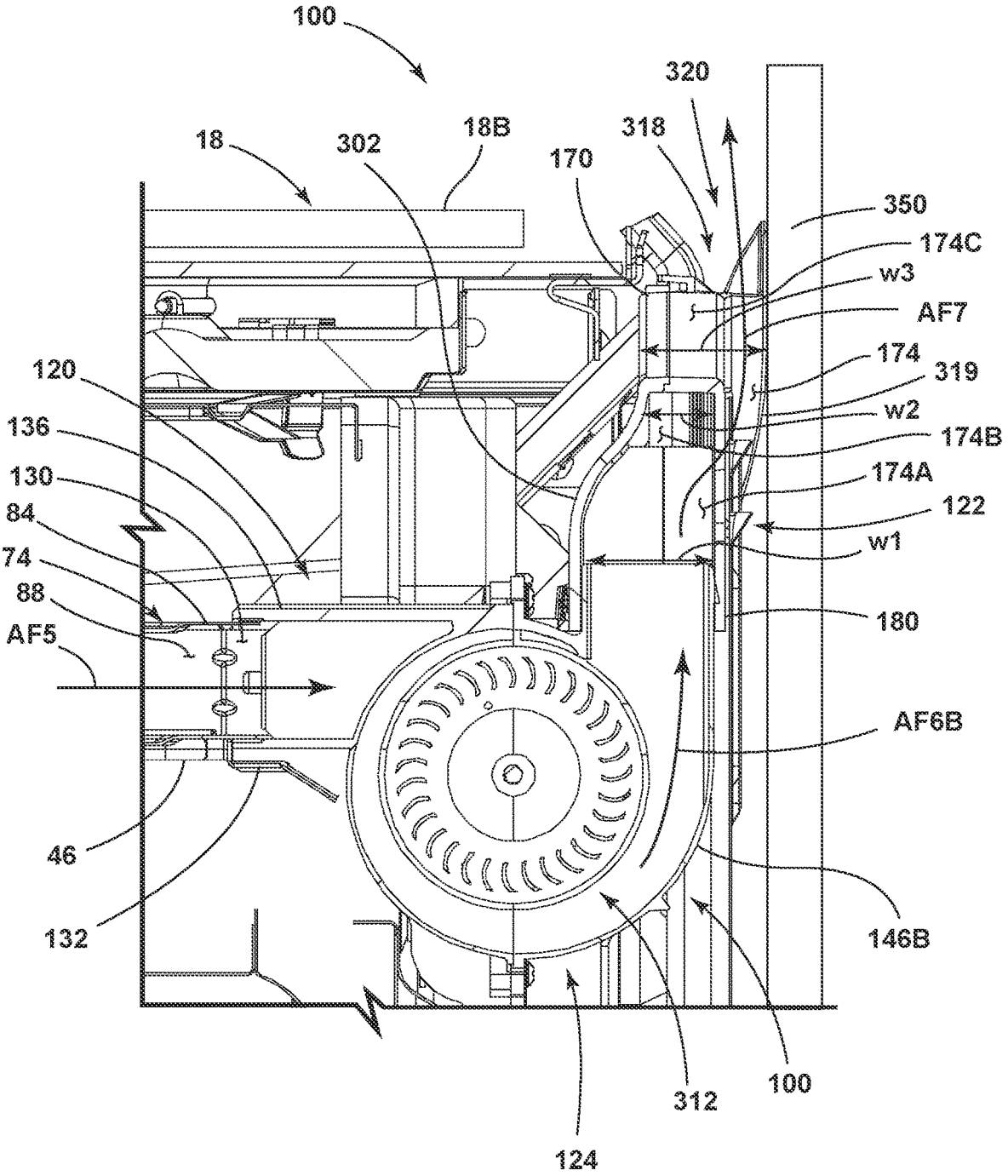
FIG. 13 is a fragmentary elevation view of the blower assembly as coupled to the cooking appliance.

Referring now to FIG. 13, the blower assembly 100 is shown drawing air from the duct assembly 74 into the inlet 120 along the horizontal airflow path as indicated by arrow AF5. The blower 312 is shown propelling air upward in the vertical airflow path as indicated by arrow AF6B towards the outlet assembly 122. The upwardly opening air outlet 318 provides for the vertical airflow along the airflow path indicated by arrow AF7. This air exits the blower assembly 100 adjacent to a cabinet wall 350. In this way, the vertical airflow indicated by arrow AF7 can provide an air curtain that protects the cabinet wall 350 from airborne particles that may be present during a cooking procedure.

As further shown in FIG. 13, the outlet assembly 122 includes a first width w1 positioned at the first portion 174A of the interior channel 174. Due to the outwardly angled configuration of the angled wall 302 of the outlet assembly 122, the outlet assembly 122 includes a second width w2 positioned at the second portion 174B of the interior channel 174. The first width w1 and the second width w2 are positioned in perpendicular directions as compared to the first and second cross-sections CS1, CS2, respectively, illustrated in FIG. 10B. As shown in FIG. 13, the first width w1 is greater than the second width w2, such that the outlet assembly 122 narrows in moving from the first portion 174A of the interior channel 174 to the second portion 174B of the interior channel 174. As further shown in FIG. 13, the outlet assembly 122 includes a third width w3 positioned at the third portion 174C of the interior channel 174. The third width w3 is greater than the second width w2, such that the outlet assembly 122 widens in moving from the second portion 174B of the interior channel 174 to the third portion 174C of the interior channel 174. The increase in width at the third portion 174C of the interior channel 174 is primarily due to the outwardly extending upwardly curved wall 319 of the rear air outlet 318. The curvature of the upwardly curved wall 319 of the rear air outlet 318 further assists in directing the air in the vertical airflow path indicated by arrow AF7. Specifically, the upwardly curved wall 319 of the rear air outlet 318 works in concert with the plurality of baffles 320 positioned at the rear air outlet 318. With the varying widths w1, w2 and w3 of the interior channel 174 of the outlet assembly 122, it is contemplated that volumes of the interior channel 174 at the first and third portions 174A, 174C of the interior channel 174 are greater than a volume at the second portion 174B of the interior channel 174.

Thus, the present concept is designed to reduce noise through a variety of techniques. The use of the outlet assembly 122, in general, muffles noise stemming from the blowers 310, 312 by providing an extra ducting path, interior channel 174, before the air exits the system, thereby trapping the acoustic sound inside the unit. The plurality of baffles 320, the first and second inner deflectors 196, 198 and the outer deflector 194 are sized and optimized appropriately to reduce the noise generated by turbulent air flow offering a smooth air flow transition from a vertical to a horizontal direction from the inlet 120 of the blower assembly 100 to the rear air outlet 318 of the blower assembly 100. Furthermore, the dimensions of the outlet assembly 122 described above and the materials thereof are selected in such a way as to not excite any natural frequencies inside the system.

According to one aspect of the present disclosure, a cooking appliance includes a cooking cavity having first and second sidewalls that are spaced-apart from one another. A housing includes first and second sidewalls that are spaced-apart from one another and an upper wall. The first and second sidewalls of the housing are spaced-apart from the first and second sidewalls of the cooking cavity to define first and second side channels therebetween, respectively. A duct assembly includes first and second sidewalls spaced-apart from one another and an upper wall. The duct assembly is positioned on the upper wall of the housing and includes an interior cavity having a front opening and a rear opening. A blower assembly includes an inlet operably coupled to the rear opening of the duct assembly and is fluidically coupled to the first and second channels. The blower assembly includes an upwardly opening rear outlet.

According to another aspect, the outlet of the blower assembly is positioned at a centrally disposed upper rear portion of the housing.

According to another aspect, the interior cavity of the duct assembly tapers from the front opening thereof to the rear opening thereof.

According to another aspect, the first sidewall of the duct assembly includes a length that is greater than a length of the second sidewall of the duct assembly.

According to another aspect, the first sidewall of the duct assembly includes one or more air inlets disposed therethrough and the second sidewall of the duct assembly includes one or more air inlets disposed therethrough.

According to another aspect, the duct assembly includes a front flange disposed above the front opening having a plurality of access apertures disposed therethrough.

According to another aspect of the present disclosure, a cooking appliance includes a housing surrounding a cooking cavity. The housing includes an upper portion having a control housing with a plurality of air inlets opening into an interior portion of the control housing. A door selectively provides access to the cooking cavity and includes upper and lower plates disposed on opposite ends of an interior portion of the door. The upper plate includes a plurality of air inlets opening into the interior portion of the door. A blower assembly includes an inlet fluidically coupled to the interior portion of the control housing and the interior portion of the door. The blower assembly further includes an outlet disposed on an upper rear portion of the housing.

According to another aspect, the lower plate of the door includes a horizontal portion having a plurality of air inlets opening into the interior portion of the door.

According to another aspect, a handle is coupled to the upper plate of the door and covers the plurality of air inlets disposed on the upper plate of the door.

According to another aspect, the upper plate of the door includes a vertical portion and the plurality of air inlets of the upper plate is positioned on the vertical portion.

According to another aspect, ambient air is drawn by the blower assembly through the plurality of air inlets of the upper plate of the door both above and below the handle by an inlet configuration of the plurality of air inlets of the upper plate of the door.

According to another aspect, the control housing includes a front panel having one or more knobs disposed thereon.

According to another aspect, the front panel of the control housing includes a first surface positioned above the one or more knobs and includes a plurality of air inlets opening into the interior portion of the control housing. The front panel of the control housing further includes a second surface positioned below the one or more knobs and includes a plurality of air inlets opening into the interior portion of the control housing.

According to another aspect, the first and second surfaces of the front panel are horizontal surfaces, and ambient air is drawn by the blower assembly through the plurality of air inlets of the first and second surfaces of the front panel both above and below the one or more knobs.

According to another aspect of the present disclosure, a cooking appliance includes a housing having a cooking cavity received therein. A blower assembly includes a motor housing having one or more blowers. An outlet assembly includes an interior channel culminating in an upwardly opening rear air outlet. The interior channel includes one or more deflectors disposed in a first portion of the interior channel. The one or more deflectors are configured to guide air from the first portion of the interior channel to a second portion of the interior channel. A first vertical airflow path is guided by the one or more deflectors to a horizontal airflow path from the first portion of the interior channel to the second portion of the interior channel. The rear air outlet includes a plurality of baffles disposed in a third portion of the interior channel. The horizontal airflow path is guided by the plurality of baffles to a second vertical airflow path.

According to another aspect, the one or more deflectors includes an outer deflector and one or more interior deflectors positioned at the first portion of the interior channel.

According to another aspect, the plurality of baffles is disposed along an upwardly curved surface of the rear air outlet, and each baffle of the plurality of baffles inwardly extends into the third portion of the interior channel.

According to another aspect, the plurality of baffles includes serially aligned baffles that inwardly extend into the third portion of the interior channel to a progressively increasing extent.

According to another aspect, a plurality of air passageways is disposed around the cooking cavity. A door selectively provides access to the cooking cavity. The door includes a plurality of air inlets opening into an interior portion of the door. A control housing includes an interior portion and a plurality of air inlets opening into the interior portion of the control housing. A duct assembly is fluidically coupled with the plurality of air passageways, the interior portion of the door and the interior portion of the control housing. The duct assembly is operably coupled to the blower assembly.

According to another aspect, the rear air outlet is centrally disposed at an upper rear portion of the housing.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising:

a cooking cavity having first and second sidewalls spaced-apart from one another;

a housing having first and second sidewalls spaced-apart from one another and an upper wall, wherein the first and second sidewalls of the housing are spaced-apart from the first and second sidewalls of the cooking cavity to define first and second side channels, respectively;

a duct assembly having first and second sidewalls spaced-apart from one another and an upper wall, wherein the duct assembly is positioned on the upper wall of the housing, and further wherein the duct assembly includes an interior cavity having a front opening and a rear opening; and a blower assembly having an inlet operably coupled to the rear opening of the duct assembly, wherein the blower assembly is fluidically coupled to the first and second channels and further wherein the blower assembly includes an outlet.

2. The cooking appliance of claim 1, wherein the outlet of the blower assembly is positioned at a centrally disposed upper rear portion of the housing.

3. The cooking appliance of claim 1, wherein the interior cavity of the duct assembly tapers from the front opening thereof to the rear opening thereof.

4. The cooking appliance of claim 1, wherein the first sidewall of the duct assembly includes a length that is greater than a length of the second sidewall of the duct assembly.

5. The cooking appliance of claim 1, wherein the first sidewall of the duct assembly includes one or more air inlets disposed therethrough and further wherein the second sidewall of the duct assembly includes one or more air inlets disposed therethrough.

6. The cooking appliance of claim 1, wherein the duct assembly includes a front flange disposed above the front opening, and further wherein the front flange of the duct assembly includes a plurality of access apertures disposed therethrough.

7. A cooking appliance, comprising:

a housing surrounding a cooking cavity, wherein the housing includes an upper portion having a control housing with a plurality of air inlets opening into an interior portion of the control housing;

a door for selectively providing access to the cooking cavity, the door including upper and lower plates disposed on opposite ends of an interior portion of the door, wherein the upper plate includes a plurality of air inlets opening into the interior portion of the door; and a blower assembly having an inlet fluidically coupled to the interior portion of the control housing and the interior portion of the door, wherein the blower assembly further includes an outlet disposed on an upper rear portion of the housing.

8. The cooking appliance of claim 7, wherein the lower plate of the door includes a horizontal portion having a plurality of air inlets opening into the interior portion of the door.

9. The cooking appliance of claim 8, including:

a handle coupled to the upper plate of the door and covering the plurality of air inlets disposed on the upper plate of the door.

10. The cooking appliance of claim 9, wherein the upper plate of the door includes a vertical portion, and further wherein the plurality of air inlets of the upper plate is positioned on the vertical portion.

11. The cooking appliance of claim 10, wherein ambient air drawn by the blower assembly through the plurality of air inlets of the upper plate of the door is drawn both above and below the handle by an inlet configuration of the plurality of air inlets of the upper plate of the door.

12. The cooking appliance of claim 7, wherein the control housing includes a front panel having one or more knobs disposed thereon.

13. The cooking appliance of claim 12, wherein the front panel of the control housing includes a first surface positioned above the one or more knobs and having a plurality of air inlets opening into the interior portion of the control housing, and further wherein the front panel of the control housing includes a second surface positioned below the one or more knobs and having a plurality of air inlets opening into the interior portion of the control housing.

14. The cooking appliance of claim 13, wherein the first and second surfaces of the front panel are horizontal surfaces, and further wherein ambient air drawn by the blower assembly through the plurality of air inlets of the first and second surfaces of the front panel is drawn both above and below the one or more knobs.

15. A cooking appliance, comprising:

a housing having a cooking cavity received therein; and a blower assembly, wherein the blower assembly includes:

a motor housing having one or more blowers;

an outlet assembly having an interior channel culminating in an upwardly opening rear air outlet, wherein the interior channel includes one or more deflectors disposed in a first portion of the interior channel, the one or more deflectors configured to guide air from the first portion of the interior channel to a second portion of the interior channel, wherein a first vertical airflow path is guided by the one or more deflectors to a horizontal airflow path from the first portion of the interior channel to the second portion of the interior channel, wherein the rear air outlet includes a plurality of baffles disposed in a third portion of the interior channel, wherein the horizontal airflow path is guided by the plurality of baffles to a second vertical airflow path.

16. The cooking appliance of claim 15, wherein the one or more deflectors includes an outer deflector and one or more interior deflectors positioned at the first portion of the interior channel.

17. The cooking appliance of claim 15, wherein the plurality of baffles is disposed along an upwardly curved surface of the rear air outlet, and further wherein each baffle of the plurality of baffles inwardly extends into the third portion of the interior channel.

18. The cooking appliance of claim 17, wherein the plurality of baffles includes serially aligned baffles that inwardly extend into the third portion of the interior channel to a progressively increasing extent.

19. The cooking appliance of claim 15, including:

a plurality of air passageways disposed around the cooking cavity;

a door for selectively providing access to the cooking cavity, the door including a plurality of air inlets opening into an interior portion of the door;

a control housing having an interior portion and a plurality of air inlets opening into the interior portion of the control housing; and a duct assembly fluidically coupled with the plurality of air passageways, the interior portion of the door and the interior portion of the control housing, and further wherein the duct assembly is operably coupled to the blower assembly.

20. The cooking appliance of claim 15, wherein the rear air outlet is centrally disposed at an upper rear portion of the housing.

* * * * *